US007631965B2

(12) United States Patent
Samoto et al.

(10) Patent No.: US 7,631,965 B2
(45) Date of Patent: Dec. 15, 2009

(54) IMAGE-RECORDING DEVICE HAVING MOVABLE CARRIAGE TO WHICH FLEXIBLE FLAT CABLE AND FLEXIBLE INK SUPPLY TUBES ARE CONNECTED

(75) Inventors: Kenji Samoto, Nagoya (JP); Noriyuki Kawamata, Nagoya (JP); Shuichi Tamaki, Nagoya (JP); Toshio Sugiura, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 516 days.

(21) Appl. No.: 11/363,152

(22) Filed: Feb. 28, 2006

(65) Prior Publication Data

US 2006/0192833 A1 Aug. 31, 2006

(30) Foreign Application Priority Data

Feb. 28, 2005 (JP) ..... 2005-052536
Feb. 28, 2005 (JP) ..... 2005-052542
Feb. 28, 2005 (JP) ..... 2005-052552

(51) Int. Cl.
*B41J 29/13* (2006.01)

(52) U.S. Cl. ..... 347/108; 347/84; 347/85

(58) Field of Classification Search ..... 347/108, 347/84, 85

See application file for complete search history.

(56) References Cited

U.S. PATENT DOCUMENTS 5,889,539 A * 3/1999 Kamoi et al. ..... 347/50
6,755,514 B2 6/2004 Koga
2003/0107624 A1* 6/2003 Koga ..... 347/85
2003/0175588 A1 9/2003 Zhang
2004/0212665 A1 10/2004 Koga

FOREIGN PATENT DOCUMENTS

JP 6320835 11/1994
JP 8207394 8/1996
JP 08207394 A * 8/1996
JP 2002240251 8/2002
JP 2003175588 6/2003

* cited by examiner

*Primary Examiner*—Manish S Shah
*Assistant Examiner*—Laura E Martin
(74) *Attorney, Agent, or Firm*—Baker Botts, LLP

(57) ABSTRACT

An image-recording device including a carriage, a recording head, a guide rail, a flexible flat cable, a flexible ink supply tubes, and a top cover. The recording head is provided at the carriage. The guide rail extends in a widthwise direction of a recording medium fed in a feeding direction perpendicular to the widthwise direction. The flat cable has a broad surface extending in a horizontal direction and bent into U-shape so that an upper region of the flat cable faces the top cover whereas a lower region of the flat cable faces the base. The carriage is reciprocally movable in the widthwise direction. The flat cable is oriented upward from the carriage at a prescribed angle with respect to a horizontal plane and extends in the widthwise direction, so that at least the U-shaped bent portion of the flat cable is in continuous contact with the top cover.

27 Claims, 21 Drawing Sheets

IMAGE-RECORDING DEVICE HAVING MOVABLE CARRIAGE TO WHICH FLEXIBLE FLAT CABLE AND FLEXIBLE INK SUPPLY TUBES ARE CONNECTED

CROSS REFERENCE TO RELATED APPLICATIONS

This application claims priority from Japanese Patent Application Nos. 2005-52536 filed Feb. 28, 2005, 2005-52542 filed Feb. 28, 2005 and 2005-52552 filed Feb. 28, 2005. The entire content of each of these priority applications is incorporated herein by reference.

BACKGROUND

The disclosure relates to an image-recording device having a recording head for ejecting ink droplets, a carriage that reciprocates in a linear direction and supports the recording head, ink supply tubes for supplying ink to the recording head from ink tanks, and a flat cable connected to the carriage for transmitting a recording signal thereto.

One type of conventional image-recording device records images on a recording medium by ejecting ink based on an input signal. One such image-recording device well known in the art provides ink to an actuator in a recording head and ejects the ink in droplets using pressure generated by the actuator based on the input signal. Here, the actuator may be a piezoelectric element, electrostriction element, or the like that generates pressure by flexing the element, or by boiling the ink locally with heating elements.

One of these image-recording devices disclosed in Japanese patent application publication No. HEI-6-320835 is a serial printer with the recording head mounted on a carriage that reciprocates in a linear direction orthogonal to the conveying direction of the recording paper. The serial printer records images by scanning the carriage each time the recording paper is conveyed by the amount of a prescribed line feed. A flexible cable called a flat cable is connected to the carriage to control the same. The flat cable must have sufficient length to follow the reciprocating motion of the carriage without interfering with that motion. The cable is disposed between the carriage and a main circuit board or the like and is bent substantially in a U-shape.

Another such image-recording device disclosed in U.S. Pat. No. 6,755,514 (corresponding to Japanese patent application publication No. 2003-175588) attempts to reduce the size of the carriage on which the recording head is mounted by providing ink tanks separately from the carriage and supplying ink to the carriage via ink supply tubes in order to lighten the load on a motor and the like used to drive the carriage. Further, this technology can reduce the overall height of the device by running the ink supply tubes laterally from the carriage in the moving direction of the carriage rather than from the top of the carriage.

FIG. 22 shows an example of a conventional image-recording device having a carriage 90 and a flat cable 91. The carriage 90 reciprocates in a direction (left-and-right direction in FIG. 22) orthogonal to the conveying direction for the recording paper, while a recording head (not shown) mounted in the carriage 90 ejects ink droplets to form images on the recording paper. The flat cable 91 is connected to the carriage 90 in order to transmit and receive electric signals between the main circuit board and the carriage 90. The flat cable 91 has an end 92 that is fixed to a frame or the like (not shown) of the image-recording device and that is electrically connected to the main circuit board. Although not shown in FIG. 22, the carriage 90 is supported on a guide rail and reciprocates by a drive force applied by a belt drive mechanism or the like. Further, the flat cable 91 is disposed on a horizontal surface of the frame or the like.

The flat cable 91 extends laterally from the carriage 90 substantially along the moving direction of the carriage 90 and subsequently curves back and runs in the opposite direction to the end 92, substantially forming a U-shape. When the carriage 90 reciprocates, the flat cable 91 follows this movement, causing the center position of the substantially U-shaped curved portion to shift. When the carriage 90 moves leftward in FIG. 22, as indicated by two dotted chain line, the radius of the U-shaped curved portion grows larger. When the carriage 90 moves rightward in the drawing, as indicated by a similar line, the flat cable 91 changes shape so that the radius of the U-shaped curved portion grows smaller.

As the radius of the curved portion in the flat cable 91 grows smaller the more the carriage 90 moves to the right, a resilient restoring force generated by the bending of the flat cable 91 also increases. This restoring force acts on the carriage 90, pushing up the carriage so that the carriage 90 floats up from the guide rail (not shown). On the other hand, since the radius of the curved part in the flat cable 91 increases the more the carriage 90 moves leftward, the restoring force generated by the bending of the flat cable 91 decreases so that the carriage 90 no longer floats up on the guide rail. When the carriage 90 floats upward on one end of its range of movement (the right side in this example), the distance from an ink ejection surface on the recording head mounted in the carriage 90 to the recording paper, referred to as the "head gap," does not remain uniform throughout the range of motion of the carriage 90. This non-uniformity adversely affects the quality of the recorded image.

If the bending rigidity of the flat cable 91 is reduced to resolve this problem, the flat cable 91 cannot maintain its U-shape shown in FIG. 22 and sags downward. As a result, the flat cable 91 can get caught on other components when the carriage 90 reciprocates or otherwise impede this reciprocating motion. Further, even if the flat cable 91 is able to maintain its U-shape, the flat cable 91 easily buckles when coming into contact with other components. These problems have become more magnified as image-recording devices are becoming more compact vertically, thereby reducing the space available for accommodating the flat cable 91 and, hence, reducing the possible radius of the curved part in the flat cable 91.

FIG. 23 shows a conventional structure that includes a supporting member 93 for supporting the flat cable 91 near the carriage 90. A top cover 94 is provided above the supporting member 93 for covering the flat cable 91 from above. A flexible member 95 formed of a sponge material or the like is disposed on the top surface of the supporting member 93 for contacting the top cover 94 with pressure. In this structure, the restoring force of the flat cable 91 generates a force F1 pushing the supporting member 93 upward. However, the top cover 94 generates a force F2 via the flexible member 95 that pushes the supporting member 93 downward, effectively canceling the force F1. Therefore, the carriage 90 does not float.

However, the pressure with which the flexible member 95 contacts the top cover 94 also increases the sliding load on the carriage 90. This increased load is applied on to the motor or other drive source used to move the carriage 90 in a reciprocating motion. As a result, a large motor is required to increase output.

Further, an excessive force F2 applied away from the driving center of gravity of the carriage 90 may act as a rotational moment on the carriage 90, and the sliding posture of the carriage 90 may become unstable as a result.

Further, although the restoring force of the flat cable 91 does not push the carriage 90 over the entire range of movement of the carriage 90, the flexible member 95 contacts the top cover 94 with pressure over this entire range of movement. As a result, an unnecessary sliding load is applied to the carriage 90 during a section of this range of movement.

Further, when the ink supply tubes described above are led laterally from the carriage and extend to the ink tanks, these ink supply tubes may sag downward due to their own weight and the weight of the ink flowing therein. Since many components, such as an encoder strip for detecting the position of the carriage, the guide rail, and conveying rollers, are disposed around the carriage, the sagging ink supply tubes may contact these components. This contact with the ink supply tubes may contaminate or warp the encoder strip, for example, affecting the accuracy of the strip in detecting the position of the carriage. The ink supply tubes may also become damaged by rubbing against the guide rail or the like.

SUMMARY

In view of the foregoing, it is an object of the invention to provide an image-recording device capable of preventing a flat cable leading from the carriage and curved in a substantially U-shape from pushing the carriage so that the carriage floats up on the guide rail.

Another object of the invention is to provide an image-recording device capable of preventing the flat cable from buckling due to contact with other members in the image-recording device.

Still another object of the invention is to prevent ink supply tubes leading from the carriage to ink tanks from sagging downward and contacting other components in the image-recording device, such as an encoder strip and the guide rail.

In order to attain at least one of the above and other objects, the invention provides an image-recording device for recording an image on a recording medium conveyed in a feeding direction, the device including a recording head, a carriage, a guide rail, a flat cable, a base, a fixing part, and a top cover. The recording head ejects ink droplets onto the recording medium. The carriage supports the recording head and is reciprocally movable along a linear moving direction orthogonal to the feeding direction. The carriage has an end portion in the feeding direction. The guide rail extends in the linear moving direction and supports at least the end portion of the carriage for guiding the carriage in the linear moving direction. The flat cable transmits a recording signal to the carriage and has a first part led from the end portion of the carriage and directing in a first direction in parallel with the linear moving direction, a curved part extending from the first part for inverting orientation, and a second part extending from the curved part and directed to a second direction opposite to the first direction. The length of the first part and second part is changeable depending on the movement of the carriage in the linear moving direction. The base is positioned below the second part of the flat cable and covers a movable region of the flat cable. The fixing part is provided on the base for securing the second part to the base. The top cover is positioned above the first part of the flat cable and covers the movable region. The first part of the flat cable has an upwardly oriented part extending from the carriage at a prescribed angle with respect to a horizontal plane capable of permitting at least a boundary portion between the first part and the curved part to be in continuous contact with the top cover while the carriage moves within a region for recording images on the recording medium.

In another aspect of the invention, there is provided an image-recording device for recording an image on a recording medium conveyed in a feeding direction, the device including a recording head, a carriage, a guide rail, a flat cable, a base, a fixing part, a top cover, a supporting member, and a restricting member. The recording head ejects ink droplets onto the recording medium. The carriage supports the recording head and is reciprocally movable along a linear moving direction orthogonal to the feeding direction. The carriage has a top surface and an end portion in the feeding direction. The guide rail extends in the linear moving direction and supports at least the end portion of the carriage for guiding the carriage in the linear moving direction. The flat cable transmits a recording signal to the carriage. The flat cable has a first part led from the end portion of the carriage and extending in the feeding direction, a second part including a folded part near the end portion of the carriage for orienting the flat cable along a first direction parallel to the linear moving direction, a curved part extending from the second part for inverting orientation, and a third part extending from the curved part and directed to a second direction opposite to the first direction. The length of the second part and third part is changeable depending on the movement of the carriage in the linear moving direction. The base is positioned below the third part of the flat cable and covers a movable region of the flat cable. The fixing part is provided on the base for securing the third part to the base. The top cover is positioned above the first part and covers the movable region. The supporting member is pivotally movably disposed on the top surface of the carriage and has a base end pivotally connected to the carriage and a free end portion protruding from the end portion of the carriage in the feeding direction and movable toward and away from the top cover. The free end portion supports the folded part so as to provide a prescribed amount of slackness in the first part. The slackness is configured to prevent the first part from being stretched when the supporting member is pivotally moved. The supporting member has a top face. The restricting member is disposed on the top face of the supporting member and is abuttable on the top cover for restricting the supporting member from pivotally moving farther toward the top cover.

DETAILED DESCRIPTION

Figure 1:
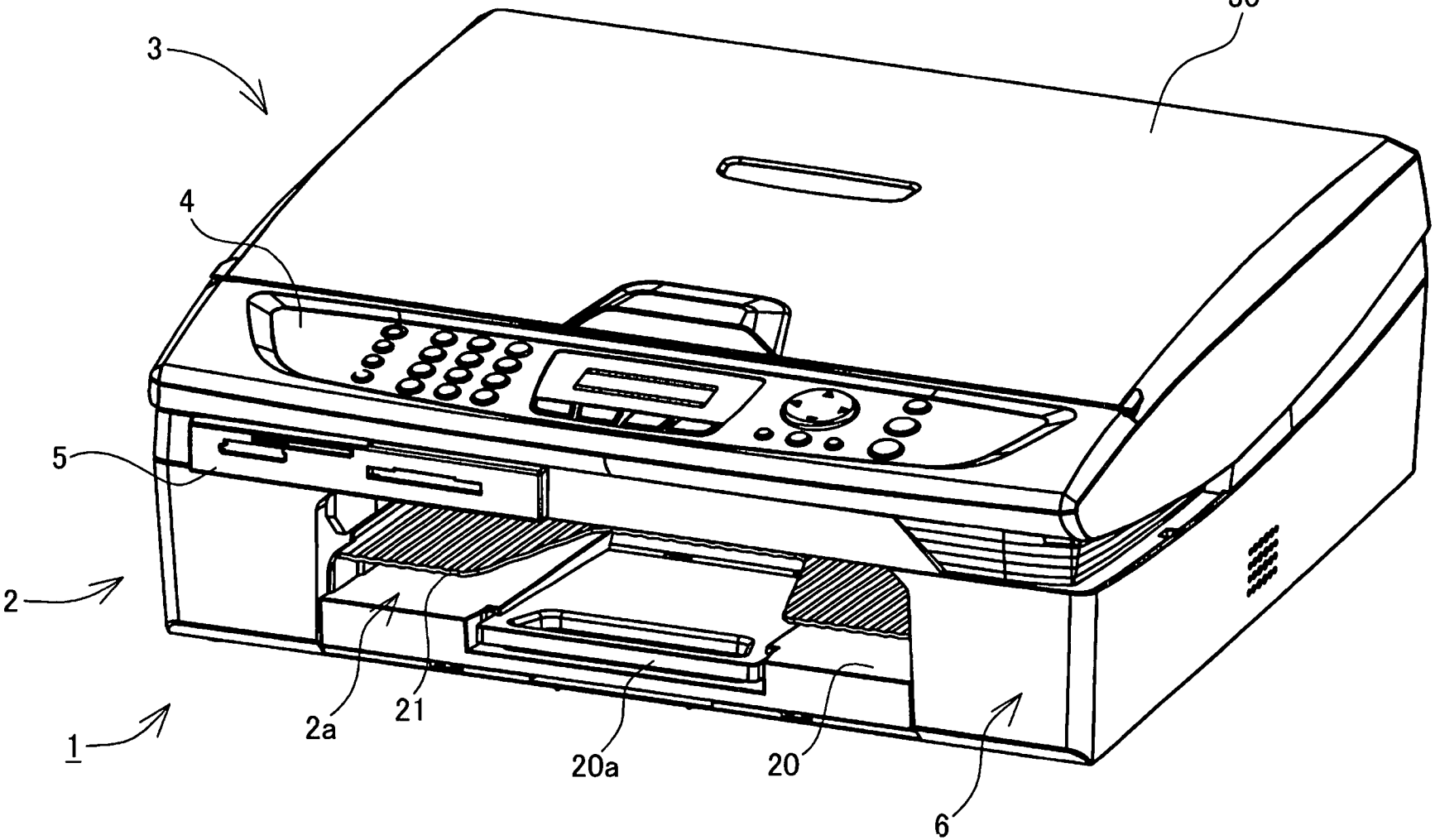
FIG. 1 is a perspective view showing an external appearance of a multifunction device according to a first illustrative aspect of the invention.

An image-recording device according to some aspects of the invention will be described while referring to the accompanying drawings wherein like parts and components are designated by the same reference numerals to avoid duplicating description.

An image-recording device according to a first illustrative aspect of the invention will be described with reference to FIGS. 1 through 12. FIG. 1 shows the external structure of a multifunction device 1 serving as the first illustrative aspect of the image-recording device. The multifunction device 1 is integrally provided with a printing unit 2 in the lower section and a scanning unit 3 in the upper section and possesses a printer function, scanner function, and copier function. The printing unit 2 in the multifunction device 1 corresponds to the image-recording device of the invention, and all functions other than the printer function are arbitrary. Therefore, the invention may be applied to a single-function printer having no scanning unit 3 and, hence, no scanner function or copier function. The multifunction device 1 may also be provided with a communication unit in order to possess a facsimile function and the like.

When implementing the image-recording device according to the invention as a multifunction device, the device may be compact as the multifunction device 1 in the first illustrative aspect, or may be a larger device including a plurality of paper cassettes and an automatic document feeder (ADF). However, the invention is particularly useful for a thinner compact image-recording device. The multifunction device 1 is primarily connected to a computer for recording text and images on a recording paper based on text or image data transferred from the computer. However, the multifunction device 1 may also be connected to an external device such as a digital camera and may record image data inputted from the digital camera on a recording paper. Also, the multifunction device 1 may be loaded with a memory card or other storage medium and may be capable of recording image data stored on the storage medium on a recording paper.

Figure 2:
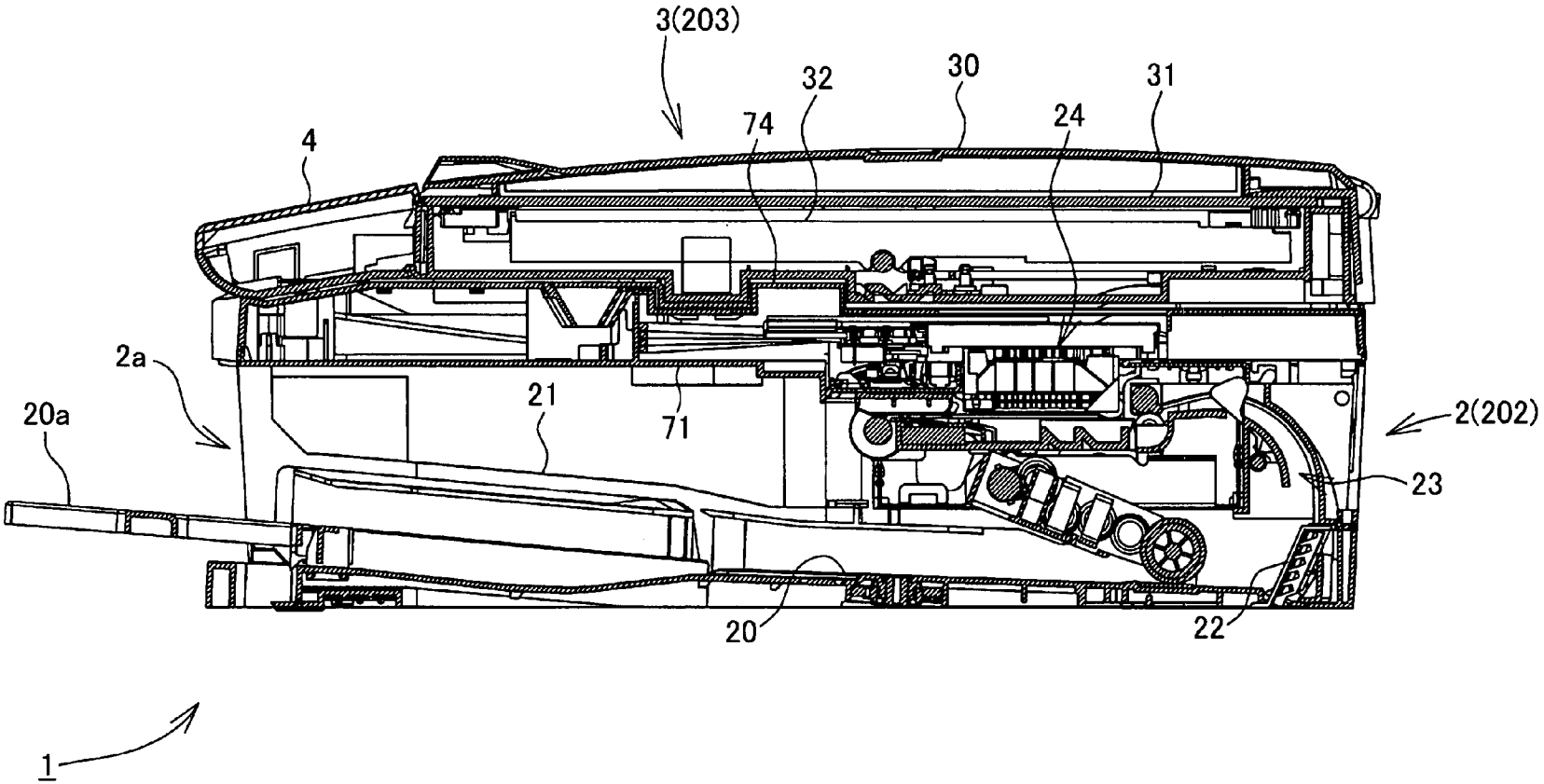
FIG. 2 is a vertical cross-sectional view showing an internal structure of the multifunction device according to the first illustrative aspect.

As shown in FIG. 1, the multifunction device 1 is substantially shaped as a thin rectangular parallelepiped with greater width and depth dimensions than the height dimension. The printing unit 2 provided in the lower section of the multifunction device 1 has an opening 2*a* formed on the front surface thereof. A paper tray 20 and a discharge tray 21 are stacked vertically as two levels in the opening 2*a* and are partially exposed therefrom. The paper tray 20 is capable of accommodating a recording paper of various sizes as large as the A4 size and including the B5 size and postcard size. The paper tray 20 includes a slidable tray 20*a* that can be pulled outward when needed, as shown in FIG. 2, to expand the surface area of the tray. Recording paper (not shown in the drawings) accommodated in the paper tray 20 is supplied into the printing unit 2 to undergo a desired image-recording process, and is subsequently discharged onto the discharge tray 21. A partitioning plate 71 (FIG. 2) is disposed above the discharge tray 21 with an appropriate space provided therebetween. The partitioning plate 71 functions to partition the interior of the discharge tray 21 from the interior of the printing unit 2. A top cover 74 (FIG. 2) is disposed above the partitioning plate 71 and is separated a prescribed distance therefrom.

The scanning unit 3 disposed in the upper section of the multifunction device 1 is a flatbed scanner. As shown in FIGS. 1 and 2, the multifunction device 1 includes an original cover 30 on the top thereof that is capable of opening and closing, and a platen glass 31 and an image sensor 32 disposed below the original cover 30. The platen glass 31 functions to support an original document when an image on the document is being scanned. The image sensor 32 is disposed below the platen glass 31 and is capable of scanning in the widthwise direction of the multifunction device 1, wherein the main scanning direction of the image sensor 32 is the depthwise direction of the multifunction device 1.

A control panel 4 is provided on the top front surface of the multifunction device 1 for operating the printing unit 2 and scanning unit 3. The control panel 4 is configured of various operating buttons and a liquid crystal display (LCD). The multifunction device 1 operates based on operating instructions inputted through the control panel 4 and, when connected to a computer, can operate based on instructions that the computer transmits by means of a printer driver. A slot section 5 in which various small memory cards or other storage media can be inserted is provided in the upper left section of the multifunction device 1 on the front surface thereof. A user can input operating instructions via the control panel 4 to read image data stored on a memory card that is inserted into the slot section 5 and to display the image data on the LCD, and can input further instructions to record a desired image on a recording paper using the printing unit 2. Incidentally, a reference numeral 6 designates an ink tank accommodating section 6 which will be described later.

Next, the internal structure of the multifunction device 1, and particularly the structure of the printing unit 2, will be described with reference to FIGS. 2 through 12. As shown in FIG. 2, a sloped separating plate 22 is disposed near the rear side of the paper tray 20 provided in the lower section of the multifunction device 1 for separating recording paper stacked in the paper tray 20 and guiding the separated paper upward. A conveying path 23 extends upward from the sloped separating plate 22, curves toward the front of the multifunction device 1, and extends in the rear-to-front direction therefrom. The conveying path 23 passes an image-recording unit 24 and leads to the discharge tray 21. Hence, the conveying path 23 guides recording paper conveyed from the paper tray 20 along a U-shaped path that curves upward and turns in the opposite direction to the image-recording unit 24. After the image-recording unit 24 has recorded an image on the paper, the paper is discharged onto the discharge tray 21.

Figure 3:
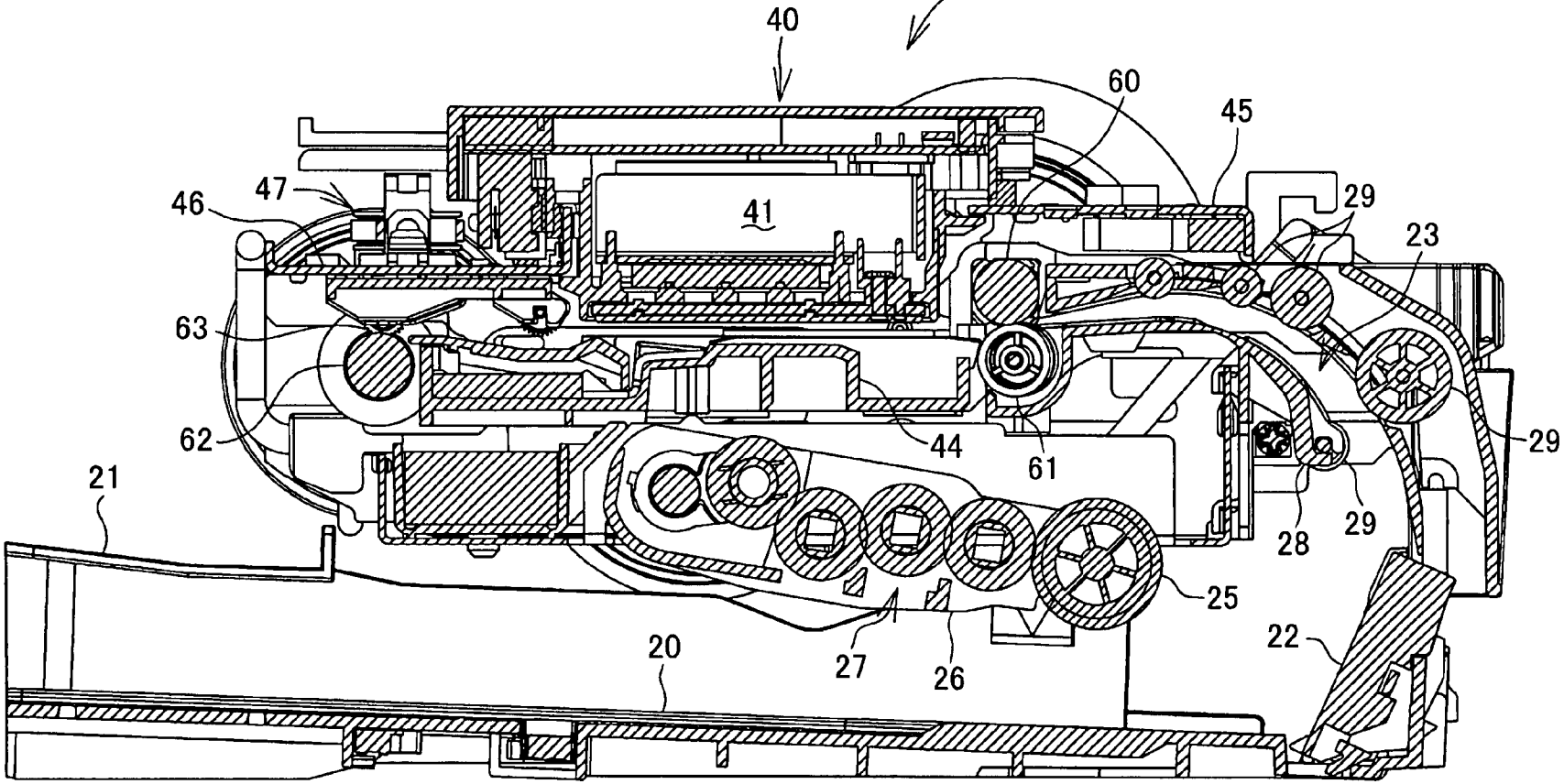
FIG. 3 is an enlarged cross-sectional view showing a general structure of a printing unit according to the first illustrative aspect.

As shown in FIG. 3, a sheet feed roller 25 is disposed above the paper tray 20 for separating paper accommodated in the paper tray 20 and supplying the paper onto the conveying path 23 one sheet at a time. The sheet feed roller 25 is supported on a free end of a feeding arm 26 that is pivotally movable toward and away from the paper tray 20. A gear transmission mechanism 27 is provided in the feeding arm 26 and includes a gear train for transmitting a driving force from a motor (not shown) to the sheet feed roller 25 in order to rotate the sheet feed roller 25.

The feeding arm 26 is disposed so as to be able to pivot up and down about a base end. During a standby state, the feeding arm 26 is urged upward by a feeding clutch, spring, and the like (not shown). The feeding arm 26 is pivoted downward when feeding the recording paper. Specifically, when the feeding arm 26 is pivoted downward, the sheet feed roller 25 supported on the end of the feeding arm 26 contacts the surface of the uppermost recording paper in the paper tray 20 with pressure. As the sheet feed roller 25 rotates in this position, a frictional force generated between the surface of the sheet feed roller 25 and the recording paper conveys the topmost sheet of recording paper toward the sloped separating plate 22. The leading edge of this sheet contacts the sloped separating plate 22 and is guided upward by the sloped separating plate 22 onto the conveying path 23. In some cases, when the sheet feed roller 25 is conveying the topmost sheet of recording paper, friction or static electricity between the topmost sheet and the underlying sheet causes the underlying sheet to be conveyed together with the topmost sheet. However, the underlying sheet is restrained when contacting the sloped separating plate 22.

Excluding the section in which the image-recording unit 24 and the like are provided, the conveying path 23 is configured of an outer guide surface and an inner guide surface that oppose each other with a prescribed gap formed therebetween. In the section of the conveying path 23 near the rear surface of the multifunction device 1, for example, the outer guide surface may be formed integrally with a frame of the multifunction device 1, while the inner guide surface may be configured of a guide member 28 fixed inside the frame. Various conveying rollers 29 are rotatably provided along the conveying path 23 and particularly in the curved region of the conveying path 23. The surfaces of the conveying rollers 29 are exposed from the outer guide surface or inner guide surface, and the axes of the conveying rollers 29 extend laterally in the conveying path 23. These conveying rollers 29 facilitate the smooth conveying of the recording paper when the paper contacts the guide surfaces in the curved region of the conveying path 23.

As shown in FIG. 3, the image-recording unit 24 is disposed in the downstream side of the U-shaped curved section of the conveying path 23. After the U-shaped section that curves from a lower section of the conveying path 23 to an upper section, the image-recording unit 24 includes a carriage 40 that reciprocates in the main scanning direction. A recording head 41 is mounted in the carriage 40. The recording head 41 ejects micro-droplets of ink in the colors cyan (C), magenta (M), yellow (Y), and black (B) to form images on the recording paper. The ink is supplied from ink tanks 42 (see FIG. 4) that are provided in the multifunction device 1 separately from the recording head 41 via ink supply tubes 43 (see FIG. 4). The recording head 41 mounted in the carriage 40 forms images on the recording paper conveyed over a platen 44 described later as the carriage 40 is scanned. A flat cable 69 is connected to the carriage 40 for transmitting a recording signal and the like thereto.

Figure 4:
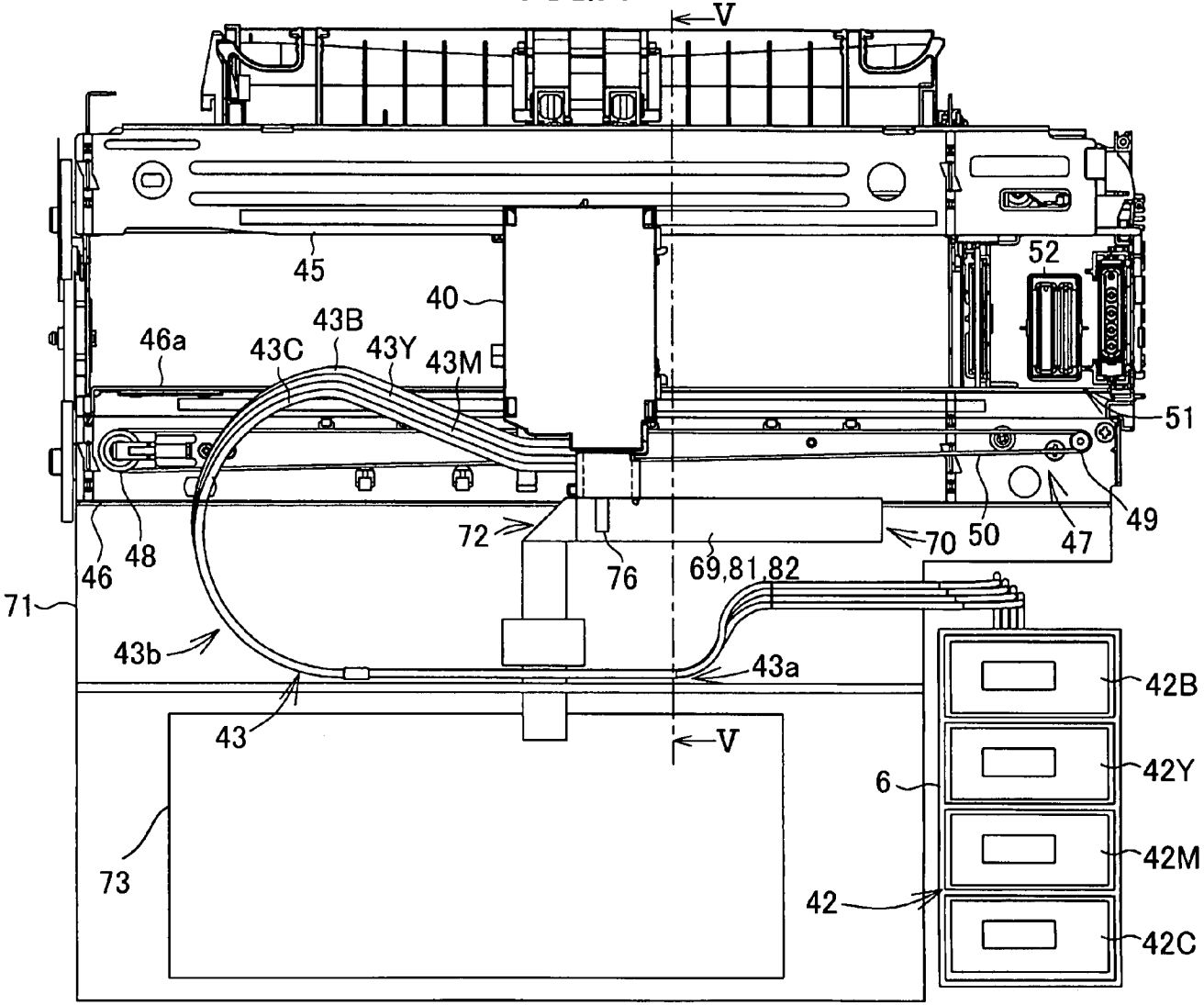
FIG. 4 is a plan view showing a region of the printing unit around a carriage and a flat cable in the first illustrative aspect.

More specifically, a pair of guide rails 45 and 46 is disposed above the conveying path 23 as shown in FIG. 4. The guide rails 45 and 46 extend in the widthwise direction of the conveying path 23 and spaced away at a prescribed distance from each other in the conveying direction of the recording paper. The carriage 40 is slidably disposed across both of the guide rails 45 and 46. The guide rail 45 is disposed upstream of the guide rail 46 in the paper-conveying direction. The guide rail 45 is plate-shaped with a dimension in the widthwise direction of the conveying path 23 greater than the scanning path of the carriage 40. The top surface of the guide rail 45 slidably supports the upstream end of the carriage 40.

Figure 5:
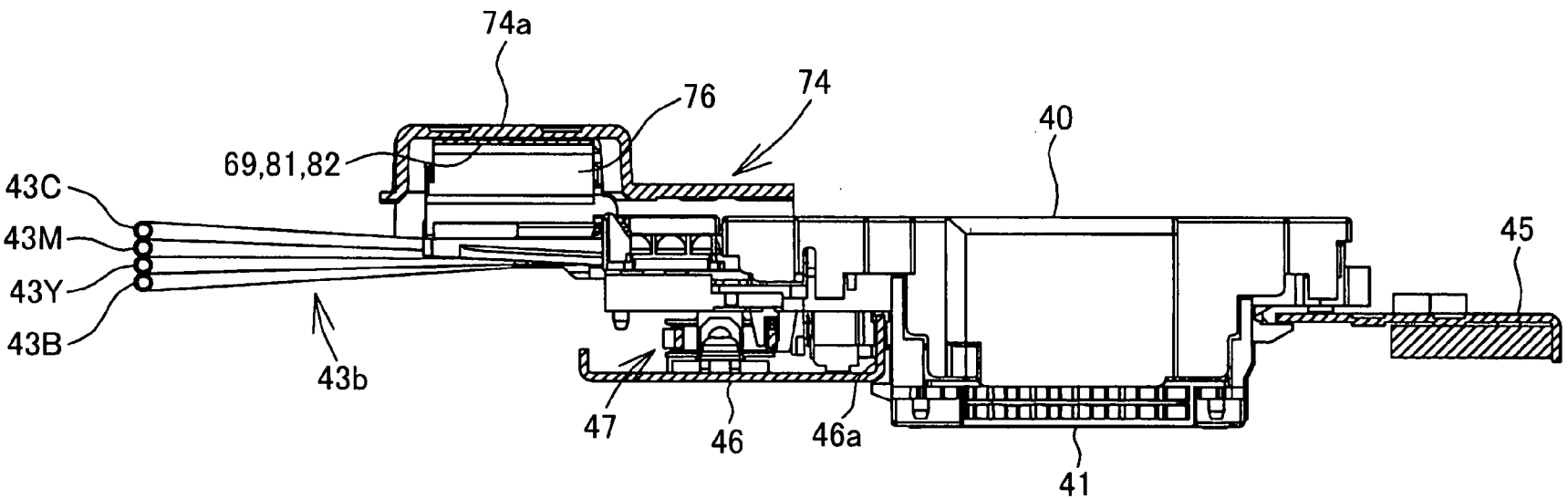
FIG. 5 is a cross-sectional view taken along the line V-V in FIG. 4 showing a structure around the carriage.

The guide rail 46 disposed on the downstream side is also plate-shaped with a dimension in the widthwise direction of the conveying path 23 substantially the same as that of the guide rail 45. As shown in FIG. 5, the guide rail 46 has an edge part 46a that is bent upward at substantially a right angle for supporting the downstream end of the carriage 40. The carriage 40 is slidably supported on the top surface of the guide rail 46. The carriage 40 has rollers (not shown) for nipping the edge part 46a. Hence, the carriage 40 is slidably supported on the guide rails 45 and 46 and is capable of reciprocating in the widthwise direction of the conveying path 23 with the edge part 46a of the guide rail 46 serving as a positional reference. Although not shown in the drawings, a low friction member for reducing friction is preferably provided on regions of the carriage 40 that contact the top surfaces of the guide rails 45 and 46.

As shown in FIG. 4, a belt drive mechanism 47 is provided on the top surface of the guide rail 46. The belt drive mechanism 47 is configured of a drive roller 48 and a driven roller 49 disposed near widthwise ends of the conveying path 23, and an endless timing belt 50 mounted over the drive roller 48 and driven roller 49 and having teeth on the inside surface thereof. A carriage motor (not shown) inputs a driving force into the shaft of the drive roller 48 for rotating the drive roller 48. The rotation of the drive roller 48 causes circular movement of the timing belt 50. Although the timing belt 50 is an endless belt in the preferred illustrative aspect, a belt with ends may also be used by fixing both ends to the carriage 40.

The carriage 40 is fixed to the timing belt 50 so that circuitous movement of the timing belt 50 causes the carriage 40 to reciprocate over the guide rails 45 and 46 using the edge part 46*a* as reference. The recording head 41 is mounted in the carriage 40 so that the recording head 41 also moves reciprocatingly in the widthwise direction of the conveying path 23. Here, the widthwise direction of the conveying path 23 is the main scanning direction. While not shown in the drawings, a strip-like encoder for detecting the carriage 40 is provided along the edge part 46*a*. Hence, the reciprocating motion of the carriage 40 can be controlled based on the positional indication from the encoder.

As shown in FIG. 3, the platen 44 is disposed on the bottom of the conveying path 23 opposing the recording head 41. The platen 44 spans a central portion among the reciprocating range of the carriage 40 through which the recording paper passes. As shown in FIG. 4, a maintenance unit including a purging mechanism 51 and a waste ink tray (not shown) are provided in a region through which the recording medium does not pass, that is, in a region outside the image-recording range of the recording head 41.

The purging mechanism 51 is adapted to draw out air bubbles and foreign matter from nozzles 53 (see FIG. 6) and the like in the recording head 41. The purging mechanism 51 includes a cap 52, a pump mechanism (not shown) and a moving mechanism (not shown). The cap 52 is adapted for covering a nozzle surface of the recording head 41. The pump mechanism is connected to the recording head 41 via the cap 52. The moving mechanism is adapted for moving the cap 52 to contact or separate from the nozzle surface of the recording head 41. When an operation is performed to remove air bubbles and the like from the recording head 41, the carriage 40 is moved so that the recording head 41 is positioned above the cap 52. Subsequently, the moving mechanism moves the cap 52 upward against the bottom surface of the recording head 41 so as to form a seal over ink ejection holes 53a (see FIG. 6) formed in this bottom surface. The pump mechanism coupled to the cap 52 then draws out ink from the nozzles 53 and the like in the recording head 41.

While not shown in the drawings, the waste ink tray is also disposed outside of the image-recording range but within the moving range of the carriage 40 for receiving ink that has been flushed out of the recording head 41. This maintenance unit can perform such maintenance as removing air bubbles and ink of different colors that has mixed from the recording head 41. The structure of the maintenance unit is arbitrary in the invention.

The ink tanks 42 are accommodated in an ink tank accommodating section 6 disposed in the front (right side) of the printing unit 2, as shown in FIG. 1. As shown in FIG. 4, the ink tanks 42 are provided separately from the carriage 40 and recording head 41 and supply ink to the carriage 40 via the ink supply tubes 43. By providing the carriage 40 and the ink tanks 42 separately in this way, the carriage 40 can be reduced in size and a smaller carriage motor can be used to drive the carriage 40, thereby enabling the overall device to be made more compact.

The ink tanks 42 include four ink tanks 42C, 42M, 42Y, and 42B accommodating ink of the respective colors cyan (C), magenta (M), yellow (Y), and black (B). The four ink tanks 42 are mounted at prescribed positions in the ink tank accommodating section 6. While not shown in detail in the drawings, each of the ink tanks 42 has a cartridge structure having a casing formed of synthetic resin that is filled with the respective color of ink. These cartridge type ink tanks 42 are detachably mounted in the ink tank accommodating section 6 from above. An opening is formed in the bottom surface of the casing for each ink tanks 42 in order to supply the ink stored in the casing. The opening is sealed with a check valve. Joints for opening these check valves are provided in the ink tank accommodating section 6. After mounting the ink tanks 42 in the ink tank accommodating section 6, ink can be supplied through the openings in the bottom of the casing by opening the check valves.

In the first illustrative aspect, the multifunction device 1 performs image recording with four colors of ink. However, the image-recording device of the invention is not particularly limited to the number of ink colors used. For example, it should be apparent that the number of ink tanks may be increased to perform image recording in six colors or eight colors. Further, the ink tanks 42 are not restricted to a cartridge type ink tank, but may be any construction that is appropriately filled with ink and that remains stationary inside the device.

As described above, ink is supplied from the ink tanks 42C, 42M 42Y, 42B mounted in the ink tank accommodating section 6 to the recording head 41 via the ink supply tubes 43. The ink supply tubes 43 are provided independently for each color. Specifically, four ink supply tubes 43C, 43M, 43Y, and 43B are provided to correspond to the respective ink tanks 42C, 42M, 42Y, and 42B. All of the ink supply tubes 43 are connected to the carriage 40.

The ink supply tubes 43 are tubes formed of synthetic resin and are flexible so as to be able to bend when the recording head 41 moves in a scanning motion. Although not shown in detail in the drawings, the opening in one end of each of the ink supply tubes 43 is connected to each one of the joints provided in the ink tank accommodating section 6 at positions corresponding to each mounted ink tank. The ink supply tube 43C corresponds to the ink tank 42C and supplies cyan ink therefrom. Similarly, the ink supply tubes 43M, 43Y, and 43B correspond to the ink tanks 42M, 42Y, and 42B and supply the corresponding ink colors magenta, yellow, and black therefrom.

From the ink tank accommodating section 6, the ink supply tubes 43 are led along the widthwise direction of the device to a position near the center thereof, at which position the ink supply tubes 43 are fixed to an appropriate member on the frame or the like. There is no restriction on the method of fixing used in this case, but an engaging part may be provided on the frame or the like for engaging the ink supply tubes 43, or the ink supply tubes 43 may be interposed in a fixing member. The fixed part of the ink supply tubes 43 will be referred to as a center fixed part 43*a*. The section of the ink supply tubes 43 from the ink tank accommodating section 6 to the center fixed part 43*a* is thus engaged or fixed to the device frame or the like at appropriate positions and is held in a fixed state to remain stationary as the carriage 40 reciprocates.

However, the section of the ink supply tubes 43 from the center fixed part 43*a* to the carriage 40 is not fixed to the device frame or the like and changes in shape as the carriage 40 reciprocates. The position of the center fixed part 43*a* should be set appropriately with consideration for the length and path of the ink supply tubes 43, and should be set within a range that allows the ink supply tubes 43 to maintain a curved state without buckling when the carriage 40 moves to the end of its range of motion, specifically the end at which the curved radius of the ink supply tubes 43 extending from the carriage 40 is smallest.

The section of the ink supply tubes 43 from the center fixed part 43*a* to the carriage 40 extends first from the carriage 40 substantially along the horizontal in the moving direction of the carriage 40, arcuately curved in an intermediate portion 43*b* substantially corresponding to a center position between the carriage 40 and center fixed part 43*a*, and then extends in the opposite horizontal direction to the first direction to the center fixed part 43*a*. Hence, the section of the ink supply tubes 43 from the center fixed part 43*a* to the carriage 40 is curved substantially in the shape of the letter U oriented laterally. The ink supply tubes 43 may extend from the carriage 40 in either direction along the reciprocating direction of the carriage 40. However, it is preferable for the ink supply tubes 43 to extend in the opposite direction of the flat cable 69 connected to the carriage 40. With this construction, the ink supply tubes 43 and flat cable 69 do not interfere with each other, and the space required for the carriage 40 can be reduced, enabling the multifunction device 1 to be made thinner. Further, as is described below, the flat cable 69 forms a substantially U-shaped loop that is inverted vertically, while the ink supply tubes 43 form a substantially U-shaped loop that is inverted horizontally.

A tube connector (not shown) is provided on the downstream end of the carriage 40 in the paper-conveying direction and protrudes downstream. The ink supply tubes 43 are engaged in the tube connector in a substantially horizontal orientation. With this construction, each ink color from the respective ink tanks 42 can be supplied through the respective ink supply tubes 43 to the recording head 41 mounted in the carriage 40.

When the carriage 40 reciprocates, the section of the ink supply tubes 43 from the center fixed part 43*a* to the carriage 40 follows the movement of the carriage 40. Hence, as the carriage 40 moves toward one end (the left side in FIG. 4) in the reciprocating direction, the ink supply tubes 43 move in the same direction of the carriage 40 while flexing so that the curved radius of the center portion 43*b* grows smaller. When the carriage 40 moves to the other end (right side) in the reciprocating direction, the ink supply tubes 43 move in the same direction while flexing so that the curved radius of the center portion 43*b* grows larger.

Figure 6:
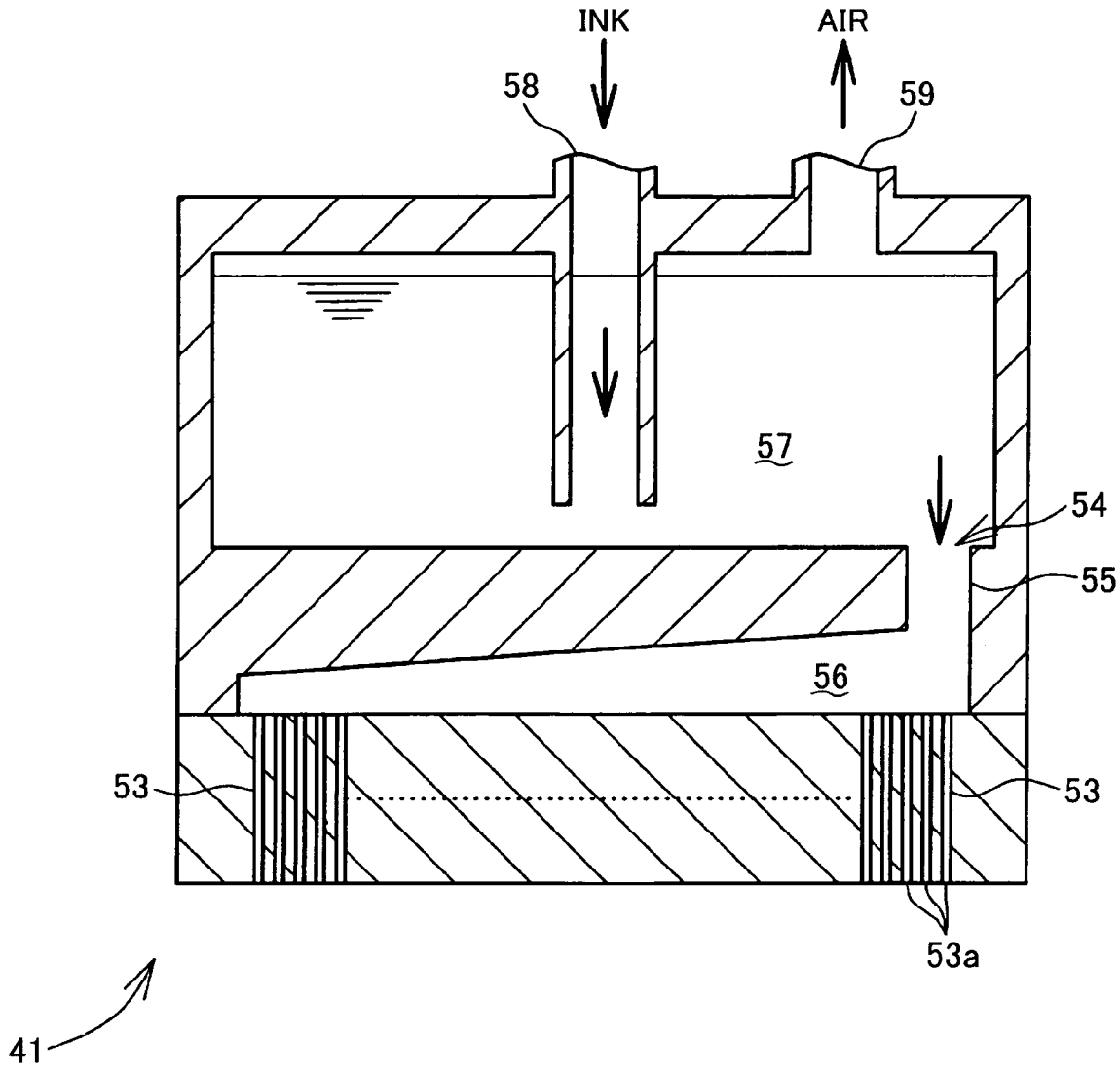
FIG. 6 is an explanatory diagram illustrating a cross-sectional structure of a recording head according to the first illustrative aspect.

As shown in FIG. 6, the ink ejection holes 53*a* are formed in the bottom surface of the recording head 41 in rows extending in the paper-conveying direction for each of the ink colors CMYB. The paper-conveying direction in FIG. 6 is the left-to-right direction. The pitch and number of ink ejection holes 53*a* in the conveying direction is set appropriately with consideration for the resolution of the images to be recorded and the like. It is also possible to increase the number of rows of the ink ejection holes 53*a* to correspond to the number of ink colors.

As shown in FIG. 6, the nozzles 53 are arranged in rows in the bottom section of the recording head 41, and the ink ejection holes 53*a* are formed as openings in the bottom surface of the recording head 41 at the lower ends of the nozzles 53. A manifold 54 is formed over the upper ends of the nozzles 53 and across all of the nozzles 53 for each respective ink color. Each manifold 54 includes a supply tube 55 formed on one end of the row of nozzles 53, and a manifold chamber 56 formed across the top ends of the nozzles 53. Ink supplied through the supply tube 55 is distributed to each of the nozzles 53 via the manifold chamber 56.

The surface of the manifold chamber 56 opposite the nozzles 53 is sloped downward in the downstream direction of ink flow so that the cross-sectional area of the manifold chamber 56 becomes smaller toward the downstream end. The side walls of the nozzles 53 are configured of a piezoelectric material, for example, as a mechanism for ejecting the ink distributed from the manifold 54 out the ink ejection holes 53*a* as ink droplets. In this case, deformation of the piezoelectric material causes ejection of an ink droplet. Another mechanism known in the art may be employed.

A buffer tank 57 is provided above the manifold 54. As with the nozzles 53 and manifold 54, the buffer tank 57 is provided for each color CMYB. An ink supply opening 58 is formed in each buffer tank 57 for supplying ink to the buffer tank 57 from the respective ink tanks 42 via the ink supply tubes 43. With this construction, the ink is not supplied directly from the ink tanks 42 to the nozzles 53, but is temporarily stored in the buffer tank 57. In this way, it is possible to capture air bubbles produced in the ink when the ink flows through the ink supply tubes 43 and the like and prevent these air bubbles from entering the nozzles 53. Air bubbles captured in the buffer tank 57 are drawn out of the buffer tank 57 through an air bubble outlet 59 by a pump mechanism (not shown).

The buffer tank 57 is in fluid communication with the manifold chamber 56 via the supply tube 55. Hence, this construction forms an ink channel by which ink of the respective color supplied from the respective ink tank 42 flows to the respective nozzles 53 via the buffer tank 57 and manifold 54. In this way, ink of each color CMYB supplied via these ink channels is subsequently ejected from the ink ejection holes 53*a* onto recording paper as ink droplets.

As shown in FIG. 3, a conveying roller 60 and a pinch roller 61 disposed in confrontation with the conveying roller 60 are provided on the upstream side of the image-recording unit 24 for receiving a sheet of paper conveyed along the conveying path 23 and, while pinching the paper therebetween, conveying the paper over the platen 44. A discharge roller 62 and an opposing spur roller 63 are disposed on the downstream side of the image-recording unit 24 for pinching and conveying the sheet of recording paper out of the recording unit 24 after the image-recording unit 24 has recorded an image thereon. A line feed motor (not shown) transmits a driving force to the conveying roller 60 and discharge roller 62 for driving the conveying roller 60 and discharge roller 62 intermittently at prescribed line feed amounts.

The pinch roller 61 is urged to press against the conveying roller 60 with a prescribed force and is freely rotatable. When a sheet of paper is interposed between the conveying roller 60 and pinch roller 61, the pinch roller 61 pinches the recording paper with the conveying roller 60 while retracting an amount equivalent to the thickness of the recording paper. In this way, the rotating force of the conveying roller 60 can reliably convey the recording paper. The spur roller 63 is similarly disposed with respect to the discharge roller 62. However, since the spur roller 63 presses against paper that has been printed, the roller surface of the spur roller 63 is shaped like a spur with alternating protruding and depressed parts so as not to degrade the image recorded on the paper.

Hence, paper interposed between the conveying roller 60 and pinch roller 61 is conveyed intermittently over the platen 44 at prescribed line feed amounts. The recording head 41 scans over the paper after each line feed to record an image beginning from the leading edge side of the paper. After an image has been recorded on the paper, the leading edge side becomes interposed between the discharge roller 62 and spur roller 63. At this time, the paper is conveyed intermittently at the prescribed line feed amount, while the leading edge side of the paper is interposed between the discharge roller 62 and spur roller 63 and the trailing edge side is interposed between the conveying roller 60 and pinch roller 61, during which time the recording head 41 continues recording an image on the paper. After the paper is conveyed farther and the trailing edge of the paper passes through and separates from the conveying roller 60 and pinch roller 61, the discharge roller 62 and spur roller 63 continue to convey the paper intermittently at the prescribed line feed amount, while the recording head 41 continues to record the image. After the image has been recorded in the prescribed recording region of the paper, the discharge roller 62 begins rotating continuously. Subsequently, the paper interposed between the discharge roller 62 and spur roller 63 is discharged onto the discharge tray 21.

Figure 7:
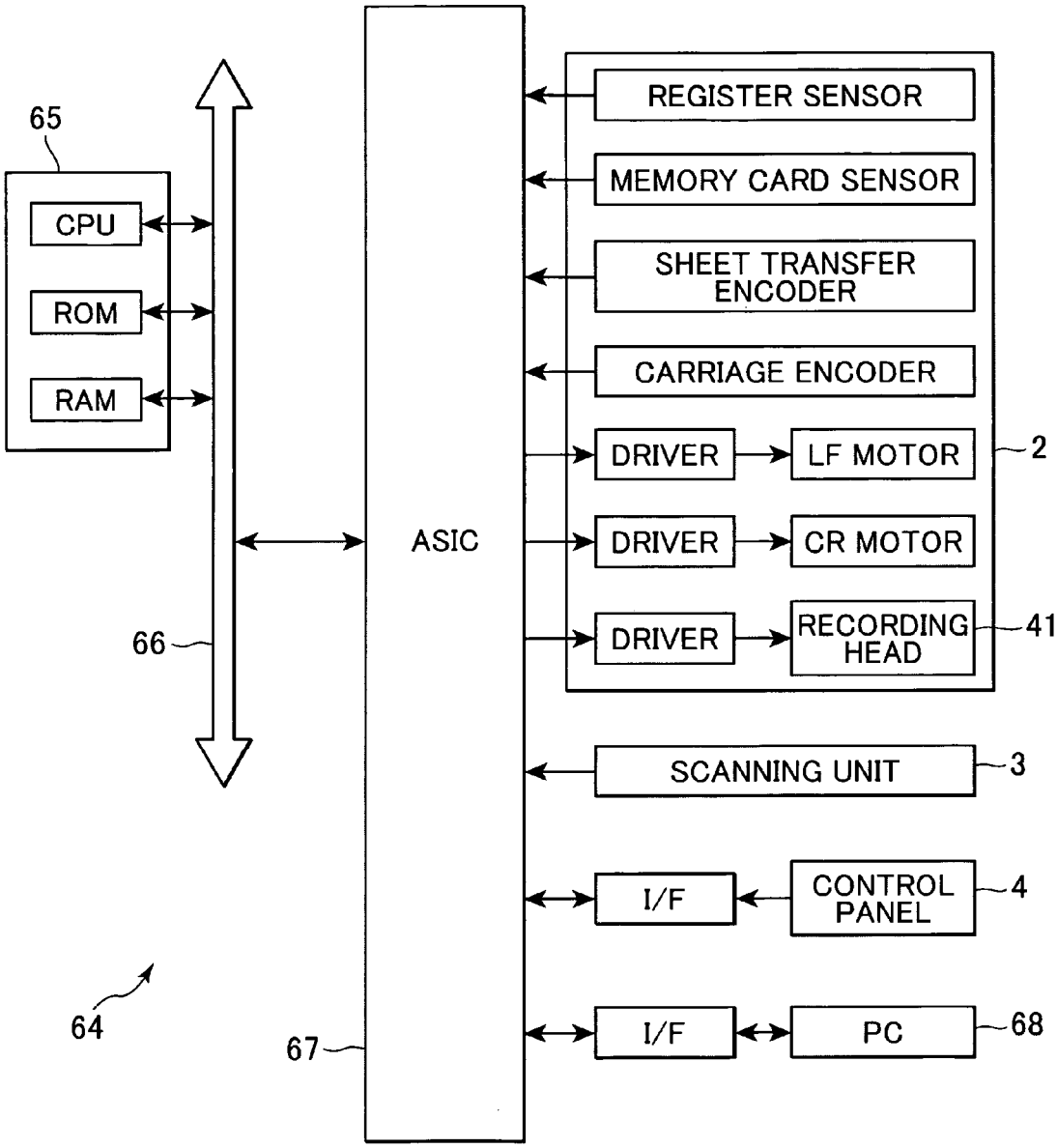
FIG. 7 is a block diagram showing a structure of a controller provided in the multifunction device according to the first illustrative aspect.

FIG. 7 is a block diagram showing the structure of a controller 64 provided in the multifunction device 1. The controller 64 is disposed on a main circuit board 73 described later and includes a central processing unit 65 configured of a central processing unit (CPU), a read only memory (ROM), and a random access memory (RAM), a bus 66, and an application specific integrated circuit (ASIC) 67. The central processing unit 65 is connected to various motors and various sensors in the printing unit 2, the scanning unit 3, the control panel 4, and the like via the bus 66 and ASIC 67, and is capable of performing data communication with these components. The printing unit 2 further includes a register sensor, a memory card sensor, a sheet transfer encoder, and a carriage encoder.

In addition to controlling the rotation of the carriage motor that moves the carriage 40 in a scanning motion and controlling the rotation of the line feed motor that drives the conveying roller 60 based on detection signals from the various sensors, the central processing unit 65 also performs overall control of the purging mechanism 51, scanning unit 3, and the like. When the carriage 40 is scanned, for example, the carriage sensor detects the encoder strip for detecting the position of the carriage and transmits a detection signal to the central processing unit 65. The central processing unit 65 controls the rotation of the carriage motor based on these detection signals to move the carriage 40 to a desired position.

Although the multifunction device 1 may be used as a standalone device to record images based on input from the control panel 4, the multifunction device 1 may also be connected to a personal computer 68 and may record text and images on paper based on text and image data transmitted from the personal computer 68. Hence, an interface is provided for exchanging data with the personal computer 68. The configuration of the controller 64 in the preferred illustrative aspect is merely an example. It should be apparent that the controller according to the invention is not limited to the construction of the controller 64.

Figure 10:
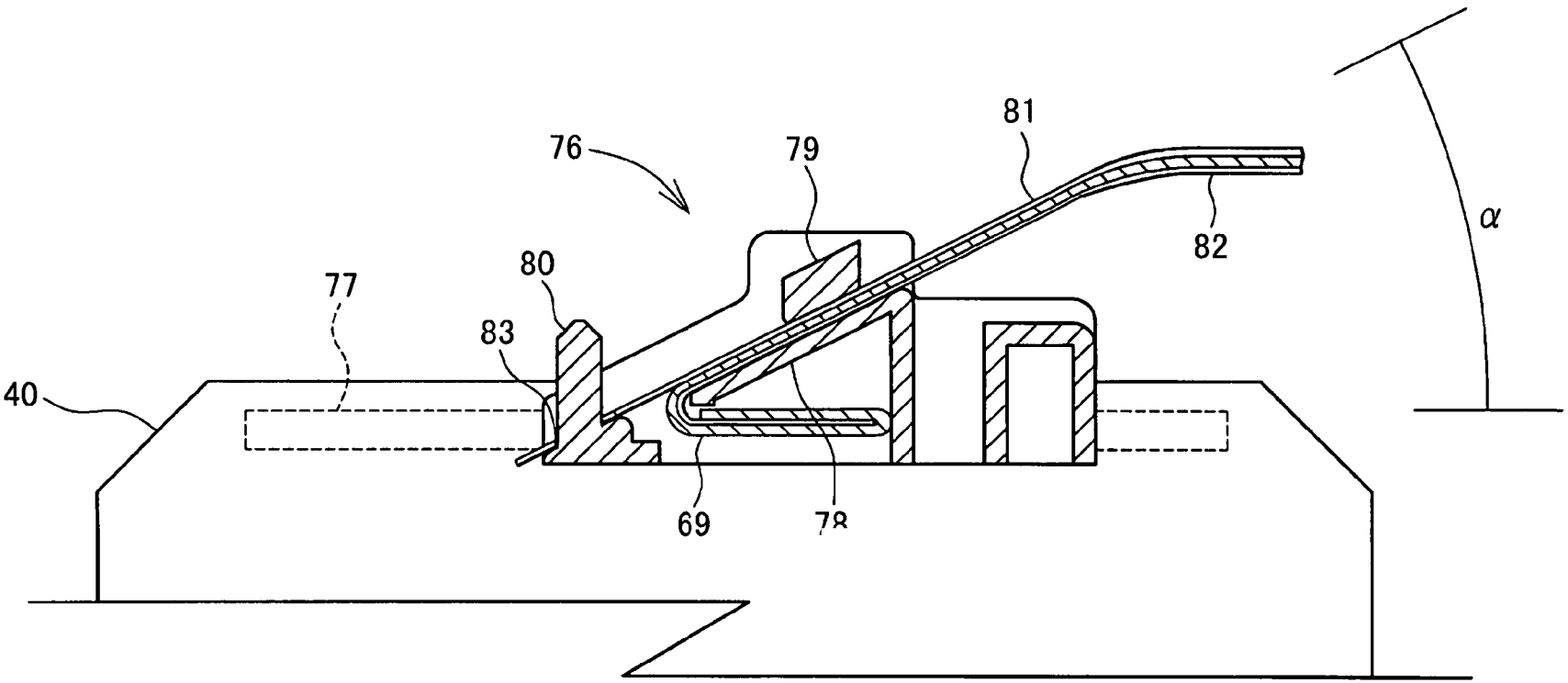
FIG. 10 is an enlarged view showing a structure of a clip member according to the first illustrative aspect.

The controller 64 transfers recording signals and the like to the carriage 40 via the flat cable 69 (see FIG. 4). The flat cable 69 is an insulated ribbon cable configured of conductors for transmitting electric signals coated in a synthetic resin film, such as a polyester film or the like. As shown in FIG. 4, the flat cable 69 extends from the downstream end of the carriage 40 in the paper-conveying direction and is positioned downstream of the carriage 40 in the same direction, with the broad surface of the flat cable 69 oriented substantially horizontally. While not shown in the drawings, the flat cable 69 is electrically connected to a control circuit board 77 (described later) of the carriage 40. Further, as shown in FIG. 10, a slip film 81 having a low frictional coefficient, and a high tenacity reinforcing film 82 are superposed over the flat cable 69.

The flat cable 69 extending from the downstream end of the carriage 40 in the paper-conveying direction is folded over directly downstream of the carriage 40 so that the flat cable 69 substantially forms a right angle with the broad surface substantially horizontal. The flat cable 69 then extends in a first direction corresponding to the reciprocating direction of the carriage 40 but opposite the direction that the ink supply tubes 43 extend from the carriage 40. A curved part 70 is formed in the flat cable 69 so that the broad surface remains substantially horizontal but is inverted vertically, substantially forming a U-shape. Hence, after the curved part 70, the flat cable 69 extends in a direction opposite the first direction (see FIG. 8A) and engages with the partitioning plate 71 near the widthwise center of the same. The portion of the partitioning plate 71 to which the flat cable 69 is fixed will be referred to as an intermediate engaging part 72. While not shown in detail in FIG. 8A, the intermediate engaging part 72 is configured of a clip-like member or the like that clamps over the flat cable 69.

At the intermediate engaging part 72, the portion of the flat cable 69 is again folded so that the flat cable 69 substantially forms a right angle to extend in the paper conveying direction with the broad surface substantially horizontal, and is connected to the main circuit board 73 on which the controller 64 is disposed. The section of the flat cable 69 from the intermediate engaging part 72 to the main circuit board 73 is appropriately fixed to the partitioning plate 71 by clip-like members or the like similar to the intermediate engaging part 72. In this way, the flat cable 69 is electrically connected on one end to the control circuit board 77 of the carriage 40 and on the other end to the main circuit board 73 in order to transfer recording signals to the carriage 40.

Figure 8A:
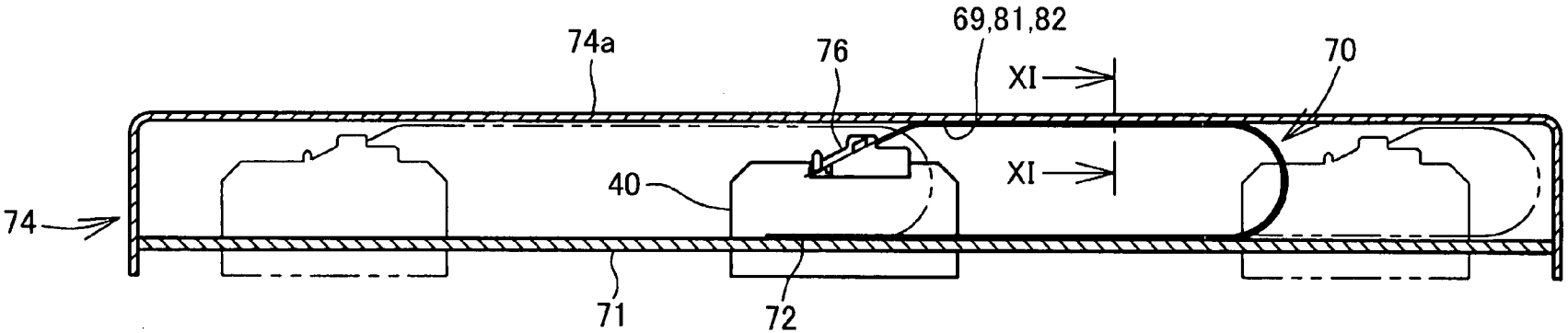
FIG. 8A is an explanatory diagram illustrating a flat cable following a reciprocating motion of the carriage in the first illustrative aspect.

A portion of the flat cable 69 extending in the reciprocating direction of the carriage 40 from the carriage 40 to the intermediate engaging part 72 is not fixed to the partitioning plate 71 by any of the fixing member, and can change shape as the carriage 40 reciprocates. In other words, as the carriage 40 reciprocates, as shown in FIG. 8A, the flat cable 69 expands and contracts along the top surface of the partitioning plate 71, while flexing so that the center of the curved part 70 moves in the same direction that the carriage 40 moves.

A movable range in which the flat cable 69 changes shape by expanding and contracting in the reciprocating direction of the carriage 40 is covered from below and above by the partitioning plate 71 and a top cover 74, respectively. The top surface of the partitioning plate 71 is substantially horizontal. The ink supply tubes 43 shown in FIG. 4 and the main circuit board 73 are arranged on the partitioning plate 71.

Obviously, other members can be arranged on the partitioning plate 71, such as the slot section 5*a* and USB connector or the like (not shown) for connecting to a computer, for example. In the preferred illustrative aspect, the main circuit board 73 and the like are arranged on the partitioning plate 71 that cover the movable range of the flat cable 69. However, the partitioning plate need not include a region for providing the main circuit board 73 and other components, provided that the partitioning plate covers at least the movable range of the flat cable 69 from the lower side.

Figure 9:
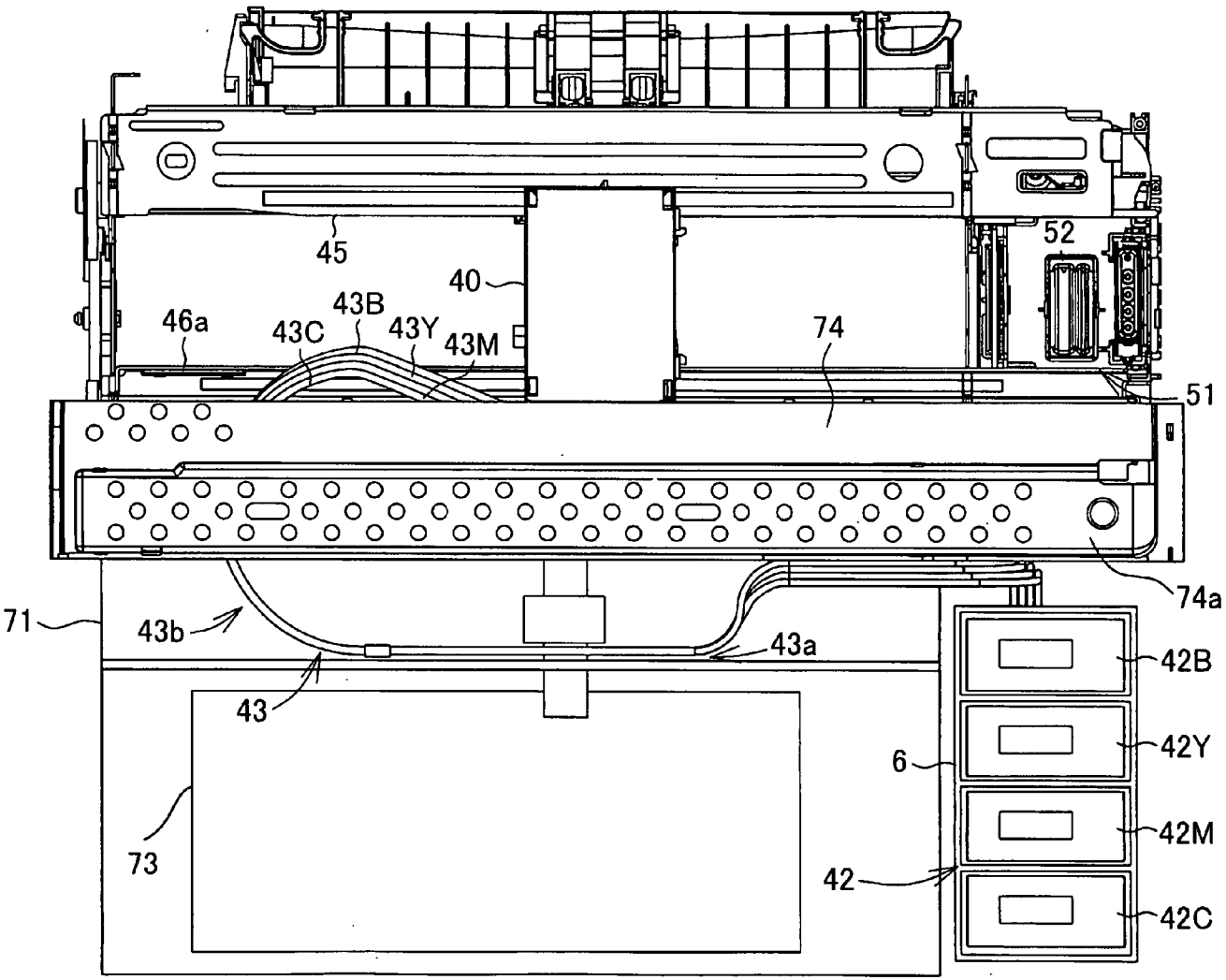
FIG. 9 is a plan view showing a layout of a top cover in the multifunction device according to the first illustrative aspect.

As shown in FIG. 9, the top cover 74 is disposed above the partitioning plate 71 and is separated a prescribed distance therefrom so as to cover the section of the flat cable 69 from the carriage 40 to the intermediate engaging part 72, that is, the section of the flat cable 69 arranged in the reciprocating direction of the carriage 40. While the top cover 74 covers the flat cable 69 and guide rail 46 from above in the first illustrative aspect, the top cover of the invention can be modified to any particular size, provided that the top cover covers at least the movable range of the flat cable 69 from above. Hence, the top cover may be configured to cover the carriage 40 from above, for example. However, in consideration for paper jams that may occur near the carriage 40, it is preferable to leave the area above the carriage 40 open so that paper near the platen 44 can be pulled out from above.

As shown in FIGS. 5 and 9, a guiding groove 74*a* is formed in the top cover 74 along the movable range of the flat cable 69, that is, along the reciprocating direction of the carriage 40. The guiding groove 74*a* is substantially rectangular in shape that is open on the bottom. That is, the lower edge is the open end. The guiding groove 74*a* is slightly wider than the flat cable 69. The flat cable 69 follows the reciprocating motion of the carriage 40 while the upper part of the flat cable 69 is fitted in the guiding groove 74*a*, as shown in FIG. 5. Hence, the upper part of the flat cable 69 does not rattle or flap as the flat cable 69 changes shape to follow the movement of the carriage 40.

As shown in FIG. 8A, the upper part of the flat cable 69 contacts the top cover 74 throughout the movable range in which the flat cable 69 changes shape to follow the carriage 40. More specifically, as shown in FIGS. 4 and 10, a clip member 76 protruding substantially along the horizontal is provided on top of the carriage 40 at the downstream end in the paper-conveying direction. The clip member 76 extends downstream in the paper-conveying direction and clamps over the flat cable 69 that has been folded to extend along the reciprocating direction of the carriage 40. The clip member 76 supports the flat cable 69 so that the flat cable 69 extends upward at a prescribed angle α.

As shown in FIG. 10, the control circuit board 77 of the carriage 40 is disposed near the top of the carriage 40, from which point the flat cable 69 leaves the top of the carriage 40. Accordingly, the clip member 76 is also provided in the top portion of the carriage 40 corresponding to the position where the flat cable 69 runs out of the carriage 40. The clip member 76 includes a sloped part 78 that is slanted so that the flat cable 69 folded at right angle to extend in the carriage reciprocating direction can extend upward at the prescribed angle α, a clamp part 79 for gripping the flat cable 69 together with the sloped part 78, and a positioning pin 80 for positioning the flat cable 69.

The top surface of the sloped part 78 slopes at the prescribed angle α upward from the reciprocating direction of the carriage 40. Hence, by supporting the flat cable 69 on the sloped part 78, the flat cable 69 also extends upward at the prescribed angle α. The angle α is set so that the region of the flat cable 69 near the curved part 70 can contact the top cover 74 as the flat cable 69 changes shape to follow the carriage 40 in the movable range.

In other words, the flat cable 69 has a first part extending in a first direction (main scanning direction) and including the upwardly oriented part extending from the carriage at a prescribed angle α with respect to the horizontal plane, the curved part extending from the first part for inverting orientation, and a second part extending from the curved part and directed to a second direction (main scanning direction) opposite to the first direction. The first part is positioned higher than the second part. The length of the first part and second part is changeable depending on the movement of the carriage in the linear moving direction. At least a boundary portion between the first part and the curved part is in continuous contact with the top cover 74 while the carriage 40 moves at least within a region for recording images on the recording medium. Here, "region for recording image" includes an actual image formation range in which image recording is actually performed on the recording medium, and acceleration and deceleration ranges of the carriage 40 prior to and subsequent to the actual image formation range.

The upwardly oriented part has a first end fixed to the carriage 40 and a second end in the first direction, and the curved part has an upper end. The above-described boundary portion includes the second end of the upwardly oriented part and the upper end of the curved part. A distance between the second end and the upper end is changeable in accordance with the reciprocating movement of the carriage 40.

Figure 8B:
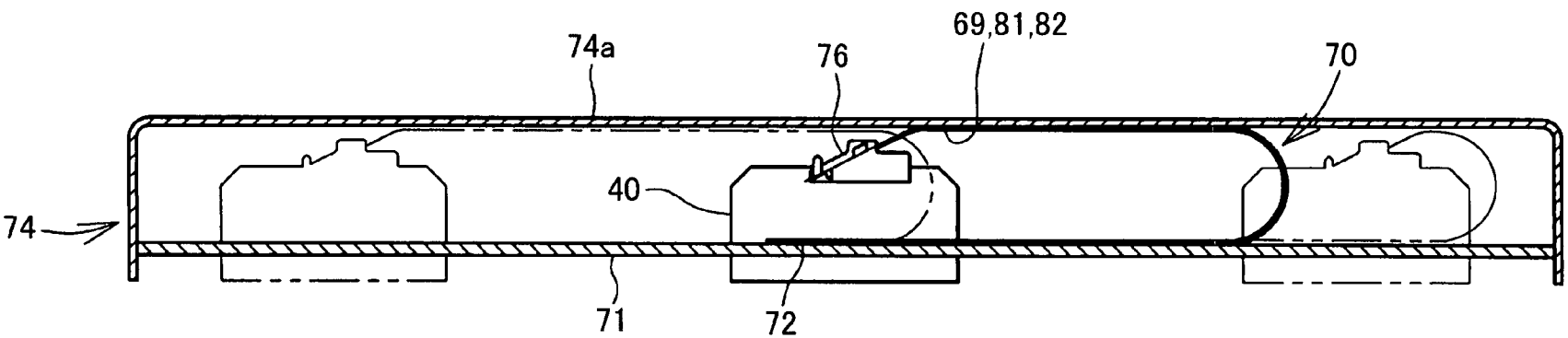
FIG. 8B is an explanatory diagram illustrating a specific contacting state of the flat cable with a top cover.

Incidentally, there may be a case as shown in FIG. 8B where the distance between the second end and the upper end becomes zero depending on the position of the carriage 40. That is, the second end and the upper end coincide in position with each other when the distance therebetween becomes zero depending on the position of the carriage 40. Further, in FIG. 8A, a portion from the second end of the upwardly oriented part to the upper end of the curved part is delineated as being in continuous contact with the top cover 74 throughout the length of the portion. However, discontinuous contact may also occur in the portion contrary to FIG. 8A as long as the second end and the upper end are in contact with the top cover 74.

The angle α is also set based on the positional relationship of the flat cable 69 with the top cover 74 and the bending rigidity of the flat cable 69. The angle α can be set within a range of about 20-40 degrees, for example. If the angle is too small, the flat cable 69 cannot be made to contact the top cover 74 in the movable range. On the other hand, an angle that is too large will generate a large load due to the frictional force between the flat cable 69 and top cover 74, which force will apply an excessive sliding load on the carriage 40 and produce a rotational moment.

The clamp part 79 is a rod-shaped member disposed on top of the sloped part 78 so as to protrude laterally on the top surface of the sloped part 78. The clamp part 79 serves as a clip that fixes the flat cable 69 when the flat cable 69 is interposed in the gap between the clamp part 79 and the sloped part 78. The positioning pin 80 protrudes upward at a position separated a prescribed gap from the clamp part 79. The slip film 81 has a hole 83 formed in an end thereof that fits over the positioning pin 80.

As shown in FIG. 10, the slip film 81 is superposed over the outer side of the flat cable 69, while the reinforcing film 82 is superposed over the inner side of the flat cable 69. The flat cable 69, slip film 81, and reinforcing film 82 are fixed as a unit in the clamp part 79. Positioning the end part of the slip film 81 on the positioning pin 80 prevents the flat cable 69, slip film 81, and reinforcing film 82 integrally clamped in the clamp part 79 from shifting as the carriage 40 reciprocates.

As shown in FIG. 8A, the flat cable 69 follows the reciprocating motion of the carriage 40, changing shape so that the center position of the curved part 70 moves in the reciprocating direction. Without providing the top cover 74, the curved part 70 would be allowed to expand upward and would change in radius as the carriage 40 reciprocated. Specifically, the radius of the curved part 70 would increase as the carriage 40 moved in a direction opposite (to the left in the drawing) the direction that the flat cable 69 extends and the upper part of the flat cable 69 increased in length. On the other hand, the radius of the curved part 70 becomes smaller when the carriage 40 moved in the extending direction of the flat cable 69 (right in the drawing) and the upper part of the flat cable 69 decreased in length.

Due to these changes in shape of the flat cable 69, the restoring force generated by the bending rigidity of the flat cable 69 would increase as the radius of the curved part 70 decreased. This restoring force would act on the carriage 40 by attempting to push the carriage 40 upward. As described above, the downstream end of the carriage 40 in the paper-conveying direction is supported on the guide rail 46. Hence, when the restoring force acted on the carriage 40, the carriage 40 would float up from the guide rail 46.

However, in the illustrative aspect shown in FIG. 8A, the part of the flat cable 69 near the curved part 70 is in contact with the top cover 74. Hence, any restoring force that attempts to expand the curved part 70 is cancelled at the point of contact with the top cover 74. Accordingly, the restoring force does not act on the carriage 40. Since the flat cable 69 is in constant contact with the top cover 74 throughout the movable range of the flat cable 69, the carriage 40 is not raised by the restoring force of the flat cable 69 throughout this movable range. Further, as shown in FIG. 10, the flat cable 69 is guided out from the top of the carriage 40, ensuring that the minimum radius of the curved part 70 in the flat cable 69 is as large as possible when the flat cable 69 changes shape along with the reciprocation of the carriage 40. This can reduce the restoring force caused by the bending rigidity of the flat cable 69 that acts on the carriage 40. Accordingly, this construction can reduce the amount of force caused by the restoring force of the flat cable 69 that attempts to raise the carriage 40.

In the first illustrative aspect, the flat cable 69 is in contact with the top cover 74 across the movable range of the flat cable 69, that is, the entire reciprocating range of the carriage 40. However, it is sufficient to ensure at least that the flat cable 69 contacts the top cover 74 throughout the region that the carriage 40 moves to record images on paper. Problems caused by the carriage 40 floating upward are manifested in a decline in printing quality as the head gap between the recording head 41 and the recording paper varies. Further, in the first illustrative aspect, the guide rails 45 and 46 are provided to support the carriage 40 on both ends in the paper-conveying direction. However, a guide shaft or the like may be used to guide the carriage 40 in place of the upstream side guide rail 45 on the side opposite the end that the flat cable 69 is provided.

Figure 11:
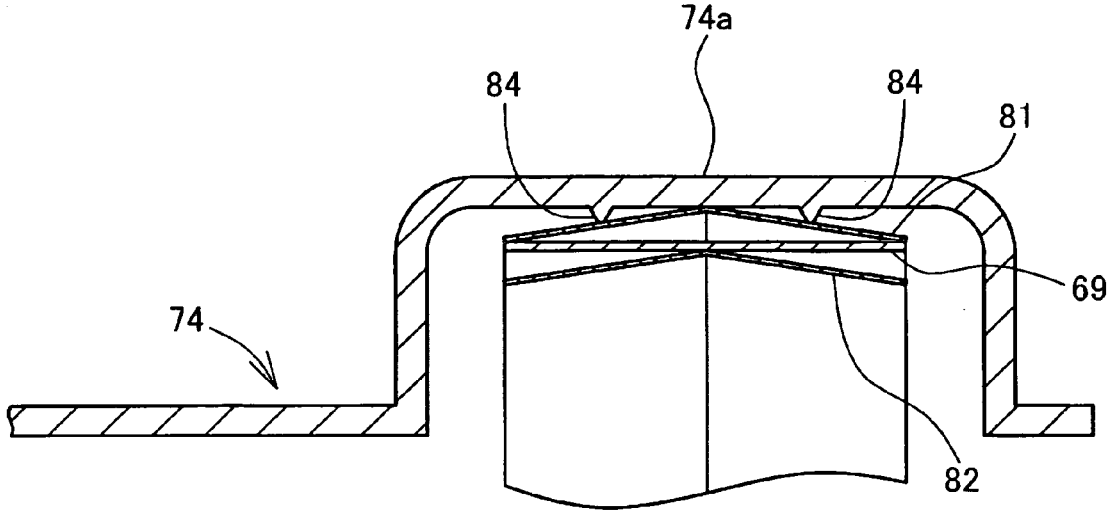
FIG. 11 is a cross-sectional view taken along the line XI-XI in FIG. 8A showing a structure of a slip film, an auxiliary film, and ribs.

As shown in FIG. 11, ribs 84 are formed on the bottom surface of the guiding groove 74*a* in the top cover 74. The ribs 84 extend in the reciprocating direction of the carriage 40 and protrude downward from the bottom surface of the guiding groove 74*a* in contact with the flat cable 69. The ribs 84 are provided in a pair that is symmetrical left-to-right about a widthwise center of the guiding groove 74*a*.

The slip film 81 is provided on the outer curved side of the flat cable 69, that is, the side of the flat cable 69 that contacts the top cover 74, so as to cover the flat cable 69. The slip film 81 functions to reduce viscous friction produced by ink mist deposited on the bottom surface of the guiding groove 74*a*, and to reduce static friction generated by static electricity between the flat cable 69 and guiding groove 74*a*. The slip film 81 may be configured of a synthetic resin film such as polyethylene terephthalate or the like, the surface of which is subjected to an antistatic treatment or a synthetic resin film that contains an antistatic material. Here, the term "ink mist" refers to scattered micro-droplets of ink that are generated when the recording head 41 ejects ink droplets. Micro-droplets of ink splatter after ink droplets impact the paper, and the like and float in the form of a mist. With this construction, the flat cable 69 does not directly contact the guiding groove 74*a* on which ink has been deposited. Instead the slip film 81 contacts the guiding groove 74*a*, reducing the viscous friction and, hence, the force of viscous friction that acts on the flat cable 69. Further, the slip film 81 does not take on an electrostatic charge when sliding in contact with the bottom surface of the guiding groove 74*a*, thereby reducing the static friction acting on the flat cable 69.

Further, the slip film 81 is bent so that a portion in the approximate longitudinal center of the slip film 81 forms an outward protruding ridge. This formation decreases the amount of surface area of the slip film 81 that contacts the bottom surface of the guiding groove 74*a*, thereby further reducing viscous friction that acts on the flat cable 69. By bending the slip film 81 in this way, the slip film 81 has a stronger tendency to curve in the desired direction than in the opposite direction. Specifically, by bending the slip film 81 to form this ridge on the outer side of the curve, the slip film 81 can easily curve in a direction that maintains the ridge on the outer side, but cannot easily curve in the opposite direction.

As shown in FIG. 8A, when the carriage 40 moves toward the left in the drawing so that the upper part of the flat cable 69 grows larger, the restoring force acting near the curved part 70 decreases. If the carriage 40 then moves from left to right from this state, while the flat cable 69 contacts the top cover 74 with a low restoring force, the flat cable 69 could potentially bend backward and buckle due to the frictional force with the top cover 74 and the like, thereby impeding the movement of the carriage 40 and damaging the flat cable 69. This danger of the flat cable 69 buckling increases when adding viscous friction caused by ink mist deposited on the bottom surface of the guiding groove 74*a*. However, the construction of the illustrative aspect prevents the flat cable 69 from buckling by providing the slip film 81 to reduce this viscous friction.

Further, as shown in FIG. 11, the ribs 84 formed on the bottom surface of the guiding groove 74*a* ensure that the slip film 81 contacts the bottom surface of the guiding groove 74*a* along a line rather than a surface. This line contact is ensured by bending the slip film 81 as described above. Hence, the slip film 81 contacts the bottom surface of the guiding groove 74*a* along three lines, thereby reducing the area of contact between the slip film 81 and guiding groove 74*a* and reducing the frictional force produced between these two components. Reducing this contact surface area also reduces the viscous friction that may occur due to ink mist becoming deposited on the bottom surface of the guiding groove 74*a*. Therefore, this construction reduces various frictional forces acting on the flat cable 69, effectively preventing the flat cable 69 from buckling, as described above.

In the first illustrative aspect, a pair of the ribs 84 is provided on the guiding groove 74*a* with left-to-right symmetry, but it should be apparent that the number and arrangement of the ribs 84 may be modified as appropriate. Further, another protruding part capable of reducing the area of contact between the slip film 81 and guiding groove 74*a*, such as a boss or other protrusion that can achieve the same effects, may be provided in place of the ribs 84. Further, while the slip film 81 is provided on the outer side of the flat cable 69 in the first illustrative aspect, the slip film 81 may be omitted. In this case, the area of contact between the flat cable 69 and guiding groove 74*a* can be reduced by bending the flat cable 69 to form an outward protruding ridge along the length of the flat cable 69 and in substantially the center region thereof, thereby reducing the various frictional forces acting on the flat cable 69.

As shown in FIG. 11, the reinforcing film 82 is provided at the inner curved side of the flat cable 69, which is out of contact from the guide groove 74. The reinforcing film 82 reinforces the bending rigidity of the flat cable 69, in other words, reinforces linearity of the flat cable 69. A synthetic resin such as polyethylene terephthalate is available as the material of the reinforcing film 82.

As described above, increasing the bending rigidity of the flat cable 69 also increases the resilient restoring force that acts on the carriage 40 and attempts to raise the carriage 40. However, reducing this bending rigidity may also cause the flat cable 69 to buckle due to the friction generated with the top cover 74. In order to modify the thickness and the like of the flat cable 69 to achieve a desired bending rigidity, it is necessary to manufacture a flat cable 69 special for the multifunction device 1, but this is not desirable in terms of cost. Therefore, by using a universal flat cable 69 with low bending rigidity and reinforcing the flat cable 69 with the reinforcing film 82, which is relatively inexpensive, it is possible to prevent buckling in the flat cable 69 with a simple and inexpensive construction.

As with the slip film 81, the reinforcing film 82 is also bent to form an outward protruding ridge along the length of the reinforcing film 82 and in substantially the center region thereof. This ridge enables the reinforcing film 82 to curve in the desired direction and makes it difficult for the reinforcing film 82 to curve in the opposite direction. Specifically, bending the reinforcing film 82 to form the ridge on the outside of the curve enables the reinforcing film 82 to curve easily in a direction that maintains the ridge on the outside, but makes it difficult for the reinforcing film 82 to curve in the opposite direction.

In the multifunction device 1 according to the first illustrative aspect described above, the region of the flat cable 69 near the curved part 70 contacts the top cover 74 as the carriage 40 moves within the reciprocating range. This contact cancels the force attempting to raise the carriage 40 upward, thereby preventing the carriages 40 from floating during its reciprocating motion and improving the image recording precision of the multifunction device 1. Further, the ribs 84 can reduce the area of contact between the curved part 70 of the flat cable 69 and the top cover 74, thereby reducing various frictional forces acting on the flat cable 69. By reducing the load applied to the carriage 40, the carriage 40 can also achieve a stable reciprocating motion. This construction also prevents the flat cable 69 from buckling while the carriage 40 reciprocates.

Figure 12:
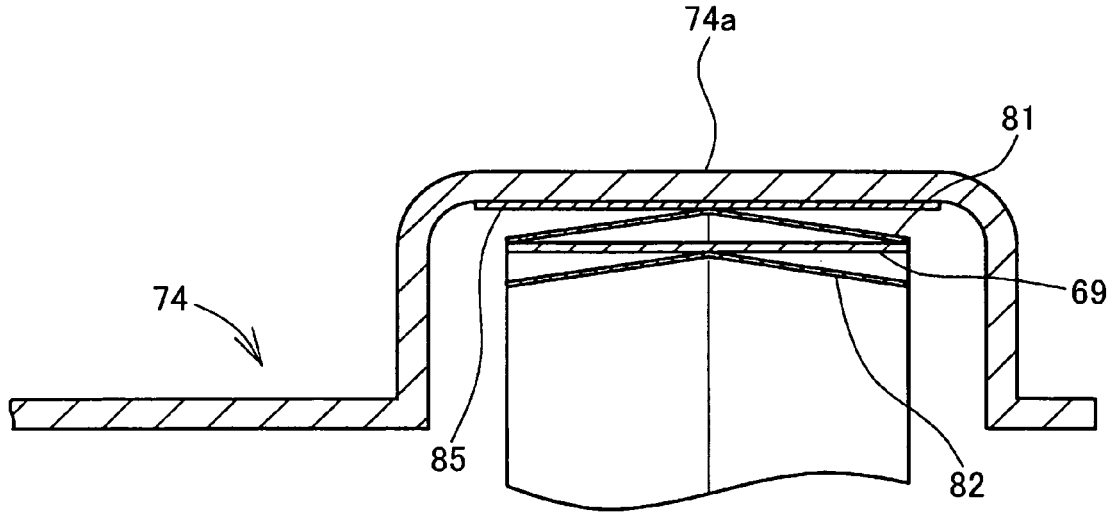
FIG. 12 is a cross-sectional view taken along the line XI-XI showing a modification to the first illustrative aspect.

FIG. 12 shows a modification to the first illustrative aspect. In place of the ribs 84, an ink absorbing sheet 85 is fixed to the bottom surface of the guiding groove 74*a*. The ink absorbing sheet 85 is a porous film formed of polyethylene or the like that absorbs ink mist deposited on the surface thereof so that such ink mist does not remain on the surface. This type of ink absorbing sheet 85 is fixed to the bottom surface of the guiding groove 74*a* by adhesive, double-sided tape, or other conventional means. The ink absorbing sheet 85 should be fixed at least along the region of the guiding groove 74*a* that is contacted by the slip film 81. When the slip film 81 is bent to form a ridge in the center region thereof, the ink absorbing sheet 85 can be fixed along the widthwise center of the guiding groove 74*a* that is contacted by the ridge of the slip film 81. When the slip film 81 is omitted, the ink absorbing sheet 85 may be fixed to the region that is contacted by the flat cable 69.

Since ink mist does not exist on the surface of the ink absorbing sheet 85 contacted by the slip film 81, viscous friction caused by ink mist is not applied to the slip film 81, thereby reducing the load applied to the flat cable 69 and preventing the flat cable 69 from buckling, as described above.

Next, an image-recording device according to a second illustrative aspect of the invention will be described with reference to FIGS. 12 through 18. The image-recording device according to the second illustrative aspect is a multifunction device 101. Since the multifunction device 101 has primarily the same construction as that of the multifunction device 1 according to the first illustrative aspect, unless otherwise stated, a value of 100 will be added to each reference numeral in the first illustrative aspect and a description of these components will be omitted except for 169A, 169B, 175, 175*a*, 175*b*, 176, 176*a*, 176*b*, 178 and 180.

Figure 13:
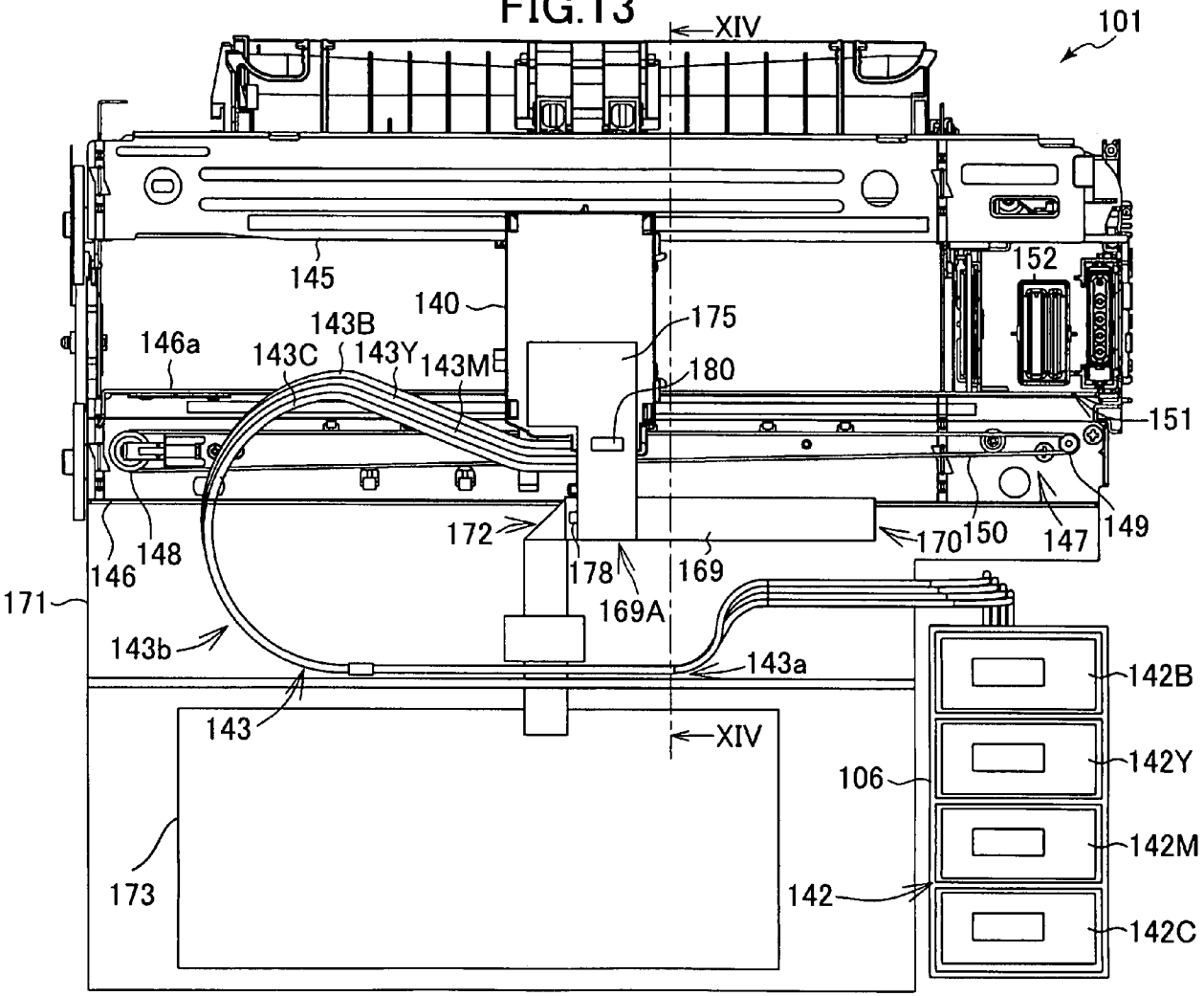
FIG. 13 is a plan view showing a structure of a printing unit around a carriage and a flat cable according to a second illustrative aspect of the invention.

As shown in FIG. 13, the flat cable 169 has a folded portion 169A directly downstream of the carriage 140 that is folded to form substantially a right angle, with the broad surface of the flat cable 169 remaining substantially horizontal. The folded portion 169A enables the flat cable 169 to extend in a direction along the reciprocating direction of the carriage 140 opposite the direction that the ink supply tubes 143 extend. A curved part 170 is formed in the flat cable 169 so that the broad surface remains substantially horizontal but is inverted vertically, substantially forming a U-shape. Hence, after the curved part 170, the flat cable 169 extends in a direction opposite the first direction (see FIG. 15) and engages with the partitioning plate 171 near the widthwise center of the same. The portion of the partitioning plate 171 to which the flat cable 169 is fixed will be referred to as an intermediate engaging part 172. While not shown in detail in FIG. 15, the intermediate engaging part 172 is configured of a clip-like member or the like that clamps over the flat cable 169.

Figure 15:
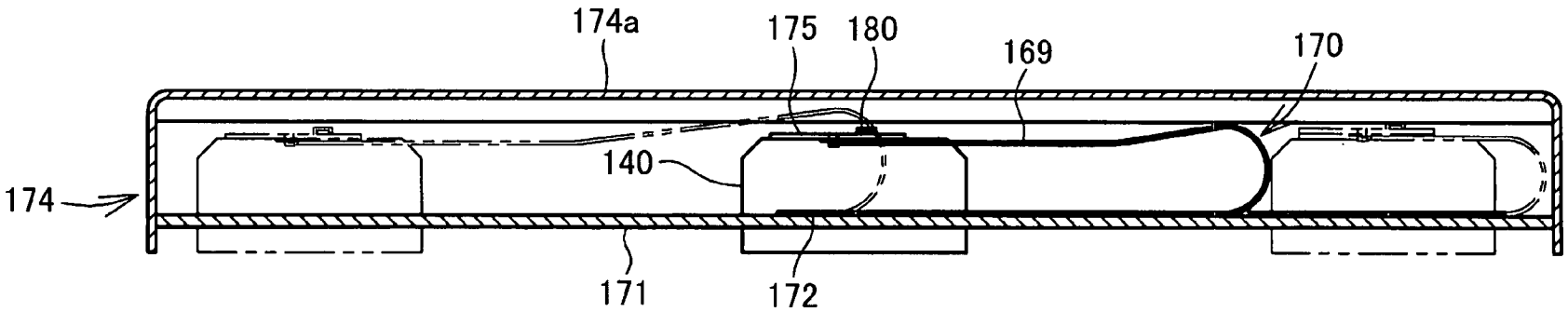
FIG. 15 is an explanatory diagram showing the flat cable following a reciprocating motion of the carriage in the second illustrative aspect.

The flat cable 169 extending from the carriage 140 is first folded at right angle to direct in the reciprocating direction. The folded portion 169A is supported on a supporting member 175 described later. Then, the flat cable 169 is bent into U-shape at the bent portion 170 and extends in an opposite direction in the reciprocating direction. Then, the flat cable 169 is folded at right angle to direct in the paper conveying direction at the position of the intermediate engaging part 172. The section of the flat cable 169 containing the U-shaped curved part 170 and spanning from the folded portion 169A to the intermediate engaging part 172 on the partitioning plate 171 is not fixed to the partition plate 171 by any fixing member and can change shape as the carriage 140 reciprocates. In other words, as the carriage 140 reciprocates, as shown in FIG. 15, the flat cable 169 follows the carriage 140 by expanding and contracting in the reciprocating direction of the carriage 140 along the top surface of the partitioning plate 171, while flexing so that the center of the curved part 170 moves in the same direction that the carriage 140 moves.

Figure 14:
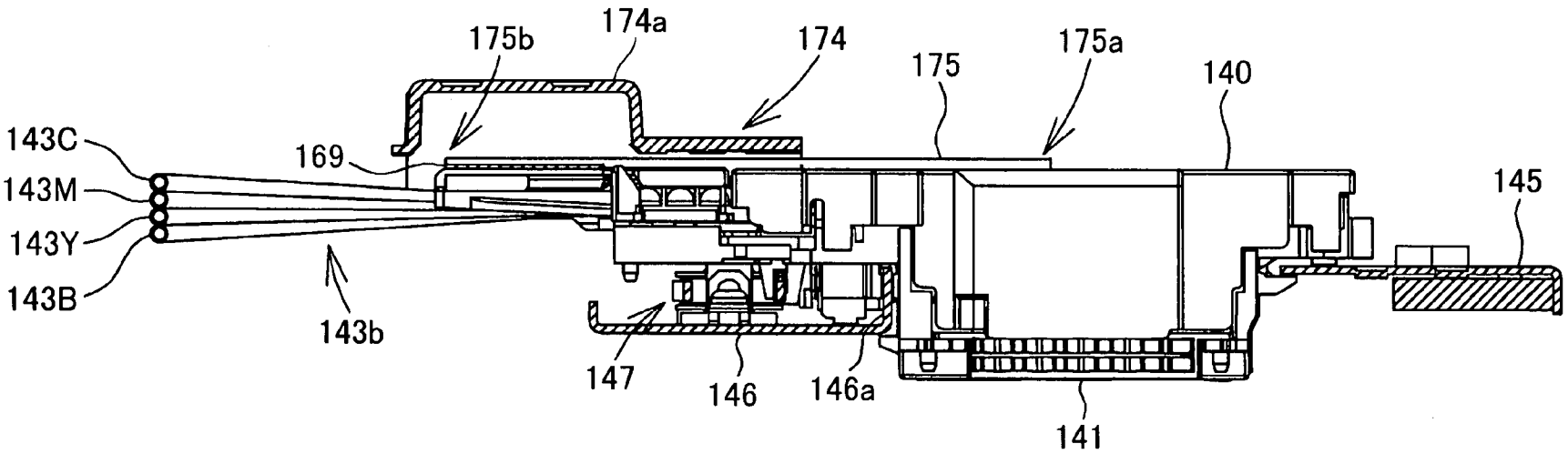
FIG. 14 is a cross-sectional view taken along the line XIV-XIV in FIG. 13 showing the structure of the printing unit around the carriage.
Figure 16:
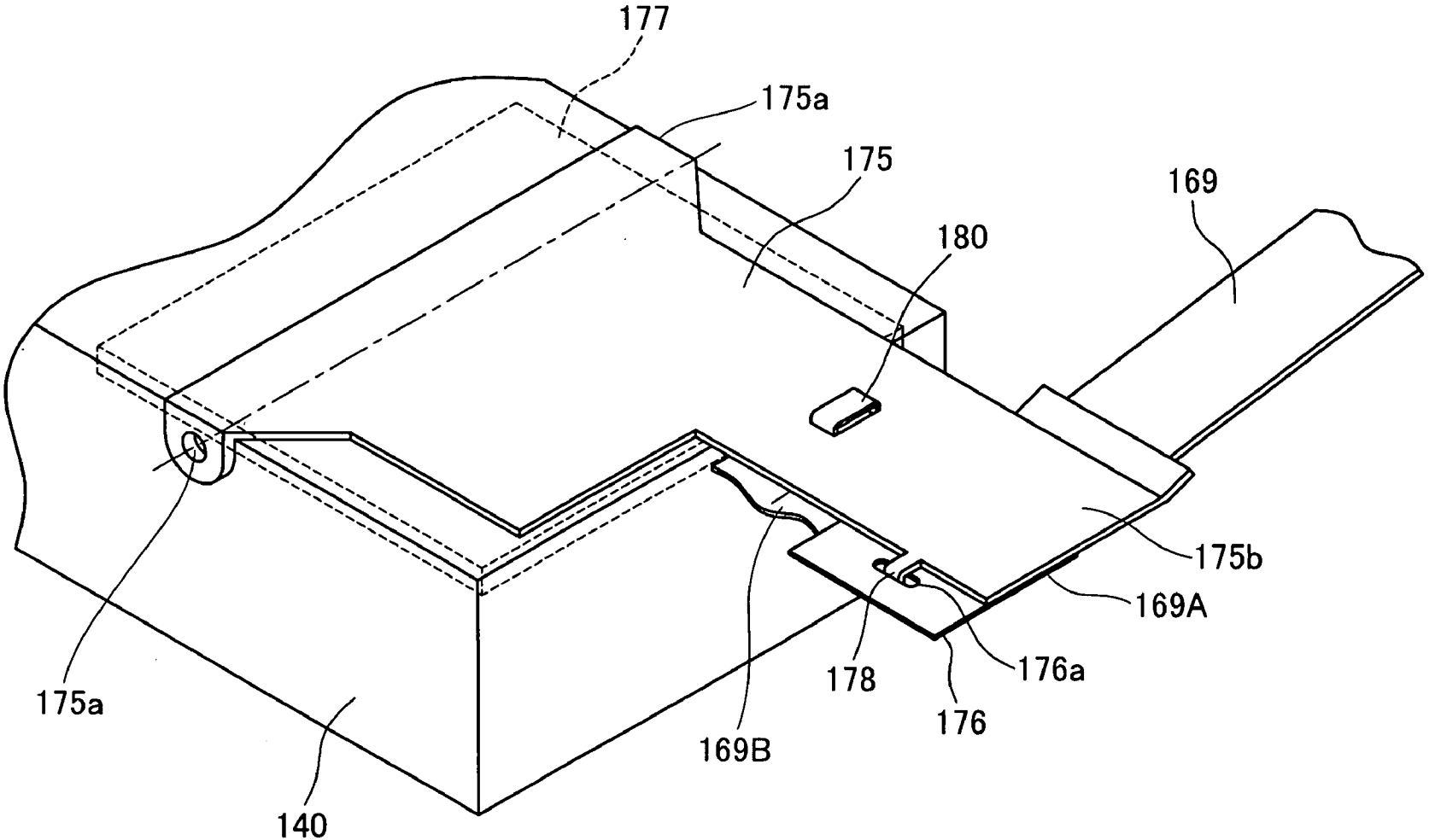
FIG. 16 is a perspective view showing a structure of the carriage around a supporting member.

As shown in FIG. 16, the supporting member 175 is a plate-shaped member pivotally movably disposed on a top surface of the carriage 140. The supporting member 175 has a base end 175*a* disposed near the driving center of gravity of the carriage 140. More specifically, as shown in FIG. 14, guide rails 145 and 146 are provided for supporting the carriage 140 on both upstream and downstream ends in the paper-conveying direction. A belt drive mechanism 147 applies a driving force to the carriage 140. Here, the driving center of gravity of the carriage 140 is determined by the positions at which the carriage 140 is supported, the position at which the driving force is applied, and the center of gravity of the carriage 140.

In some cases, if a sliding load of some type is applied to the carriage 140, a rotational moment may be produced in the carriage 140 about the driving center of gravity. To reduce the occurrence of this rotational moment, the pivot center 175*a* at which the force from the supporting member 175 to the carriage 140 is transferred should be positioned near the driving center of gravity. While the location of the driving center of gravity is determined by the structure and the like around the carriage 140, the driving center of gravity should be inside the positions at which the guide rails 145 and 146 support the carriage 140, as shown in FIG. 14. Further, since the belt drive mechanism 147 applies a drive force to the carriage 140 on the side from which the flat cable 169 extends in the second illustrative aspect, the pivot position 175*a* of the supporting member 175 should be positioned between the center of gravity of the carriage 140 and the supporting position of the guide rail 146 on the downstream end of the carriage 140 in the paper-conveying direction.

The structure for attaching the base end 175*a* to the top surface of the carriage 140 is not restricted, provided that the supporting member 175 can be pivotally movable about an axis extending in the reciprocating direction of the carriage 140. Hence, the base end 175*a* of the supporting member 175 may be attached to the top surface of the carriage 140 via a hinge construction or a shaft member, for example.

As shown in FIG. 16, the supporting member 175 has a free end 175*b* protruding on the side from which the flat cable 169 extends, that is, downstream in the paper-conveying direction. The protruding part of the free end 175*b* supports the folded portion 169A of the flat cable 169. A positioning film 176 formed of a synthetic resin or the like is fixed to the folded portion 169A. Part of the positioning film 176 protrudes from the folded portion 169A in the direction opposite that the flat cable 169 extends in the reciprocating direction of the carriage 140. An elongated hole 176*a* is formed in this protruding part of the positioning film 176 and extends in a direction orthogonal to the reciprocating direction of the carriage 140.

An engaging piece 178 is provided on a side of the free end 175*b*, and is engaged with the elongated hole 176*a* of the positioning film 176. As shown in FIG. 16, the engaging piece 178 has a hook shape that protrudes from a side edge of the free end 175*b* in the same direction as the protruding direction of the positioning film 176. By engagingly inserting the engaging piece 178 in the elongated hole 176*a*, the supporting member 175 supports the flat cable 169 with the region of the flat cable 169 near the folded portion 169A positioned on the bottom surface of the supporting member 175. In this way, the supporting member 175 can support the flat cable 169 via the positioning film 176 without directly supporting the folded portion 169A, thereby avoiding an excessive load being applied to the region near the folded portion 169A due to vertical movement of the flat cable 169.

A slack part 169B is formed in the flat cable 169 supported by the supporting member 175 in the region from the carriage 140 to the folded portion 169A. The slack part 169B has a prescribed amount of slack in the direction that the flat cable 169 extends. The control circuit board 177 is disposed in the carriage 140 near the top thereof for controlling operations of the carriage 140. The flat cable 169 is connected to the control circuit board 177 and is led out from the top of the carriage 140. Subsequently, the flat cable 169 is folded over at the folded portion 169A to extend in the reciprocating direction of the carriage 140. However, the length of the flat cable 169 from the position that the flat cable 169 leaves the carriage 140 to the folded portion 169A is sufficiently longer than the length of the supporting member 175 protruding from the carriage 140.

Hence, when the supporting member 175 supports the folded portion 169A through the positioning film 176 as described above, the slack part 169B is produced in the flat cable 169. If the supporting member 175 is pivotally moved upward, as described above, the slack part 169B allows the region of the flat cable 169 near the folded portion 169A supported on the supporting member 175 to move upward together with the supporting member 175. If the portion of the flat cable 169 leading from the carriage 140 to the flat cable 169 were taut at this time, this portion of the flat cable 169 would attempt to raise the carriage 140. In this connection, the slack part 169B absorbs the raising tendency of the carriage due to pivotal motion of the supporting member 175.

Further, by forming the elongated hole 176*a* in the positioning film 176 to be sufficiently long in the direction orthogonal to the reciprocating direction of the carriage 140, the flat cable 169 supported by the supporting member 175 via the positioning film 176 has a degree of play for moving an amount equivalent to the range that the engaging piece 178 of the supporting member 175 can move within the length of the elongated hole 176*a*. Accordingly, the flat cable 169 has an appropriate degree of play to move vertically along with the pivotal motion of the supporting member 175, thereby preventing an excessive load from being applied to the folded portion 169A. While in the second illustrative aspect the positioning film 176 protrudes from the folded portion 169A in a direction opposite the extending direction of the flat cable 169, the direction in which the positioning film 176 protrudes is arbitrary. For example, the positioning film 176 may protrude in a direction orthogonal to the reciprocating direction of the carriage 140.

In addition, a restricting member 180 is provided in the top surface of the supporting member 175 in a region of the supporting member 175 that protrudes from the carriage 140. The restricting member 180 protrudes upward from the top surface of the supporting member 175 and contacts the top cover 174 when the supporting member 175 is pivotally moved upward, to restrict the range of the supporting member 175 to a prescribed pivotal moving range. The restricting member 180 may be configured by raising part of the top surface of the supporting member 175 upward or by fixing a separate member to the top surface of the supporting member 175, for example. The raised height of the restricting member 180 is set with consideration for the positional relationship with the top cover 174.

As shown in FIG. 15, the movable range of the flat cable 169 in which the flat cable 169 changes shape to expand and contract in the reciprocating direction of the carriage 140 is covered from below and above by the partitioning plate 171 and the top cover 174. The top surface of the partitioning plate 171 is substantially level. As shown in FIG. 13, the ink supply tubes 143 and the main circuit board 173 are arranged on the partitioning plate 171.

Obviously, other members can be arranged on the partitioning plate 171, such as the slot section 5 and a USB connector or the like (not shown) for connecting to a computer, for example. In the second illustrative aspect, the main circuit board 173 and the like are arranged on the partitioning plate 171 that cover the movable range of the flat cable 169. However, the partitioning plate 171 need not include a region for providing the main circuit board 173 and other components, provided that the partitioning plate 171 covers at least the movable range of the flat cable 169 from the lower side.

Figure 17:
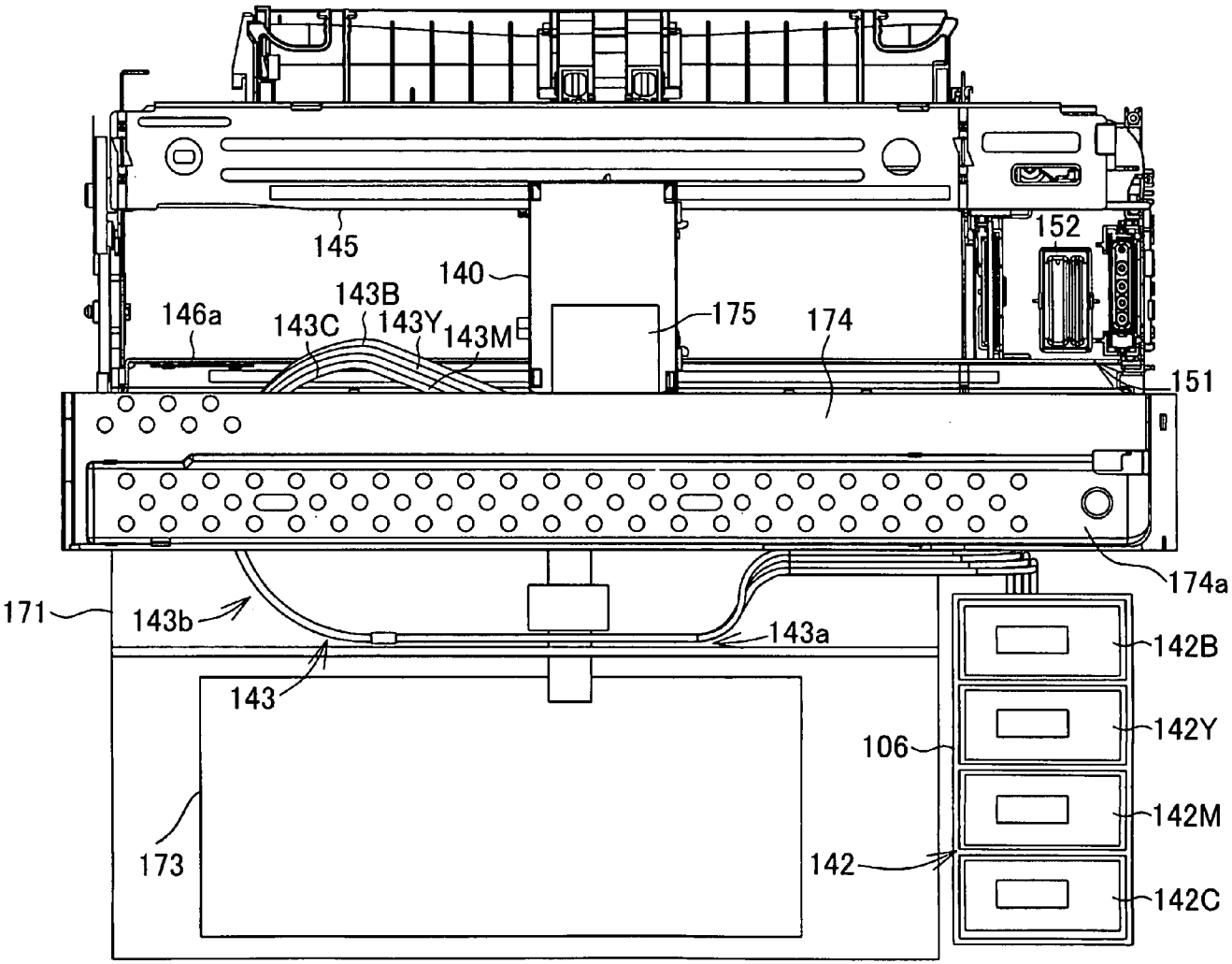
FIG. 17 is a plan view showing a structure of a top cover according to the second illustrative aspect.

As shown in FIGS. 15 and 17, the top cover 174 is disposed above the partitioning plate 171 and is separated a prescribed distance therefrom so as to cover the section of the flat cable 169 from the carriage 140 to the intermediate engaging part 172, that is, the section of the flat cable 169 arranged in the reciprocating direction of the carriage 140. While the top cover 174 covers the flat cable 169 and guide rail 146 from above in the second illustrative aspect, the top cover can be modified to any particular size, provided that the top cover covers at least the movable range of the flat cable 169 from above. Hence, the top cover may be configured to cover the carriage 140 from above, for example. However, in consideration for paper jams that may occur near the carriage 140, it is preferable to leave the area above the carriage 140 open so that paper near the platen 144 can be pulled out from above.

Further, a guiding groove 174*a* is formed in the top cover 174 along the movable range of the flat cable 169, that is, along the reciprocating direction of the carriage 140. The guiding groove 174*a* is substantially rectangular in shape that is open on the bottom. The guiding groove 174*a* is slightly wider than the flat cable 169.

As shown in FIG. 15, the flat cable 169 follows the reciprocating motion of the carriage 140, changing shape so that the center position of the curved part 170 moves in the reciprocating direction. The curved part 170 of the flat cable 169 expands upward and changes in radius as the carriage 140 reciprocates. Specifically, the radius of the curved part 170 increases as the carriage 140 moves in a direction opposite (to the left in the drawing) the direction that the flat cable 169 extends and the upper part of the flat cable 169 increases in length, and grows smaller when the carriage 140 moves in the extending direction of the flat cable 169 (right in the drawing) and the upper part of the flat cable 169 decreases in length.

As the flat cable 169 changes in shape so that the radius of the curved part 170 decreases, the restoring force generated by the bending rigidity of the flat cable 169 increases. This restoring force acts to move the region of the flat cable 169 around the folded portion 169A upward to increase the radius of the curved part 170. If the region of the folded portion 169A were to rise beyond a prescribed position, the carriage 140 may be pushed upward. As described above, the downstream end of the carriage 140 in the paper-conveying direction is supported on the guide rail 146. Hence, external force acting against the weight of the carriage 140 could raise the carriage 140 up from the guide rail 146.

Figure 18:
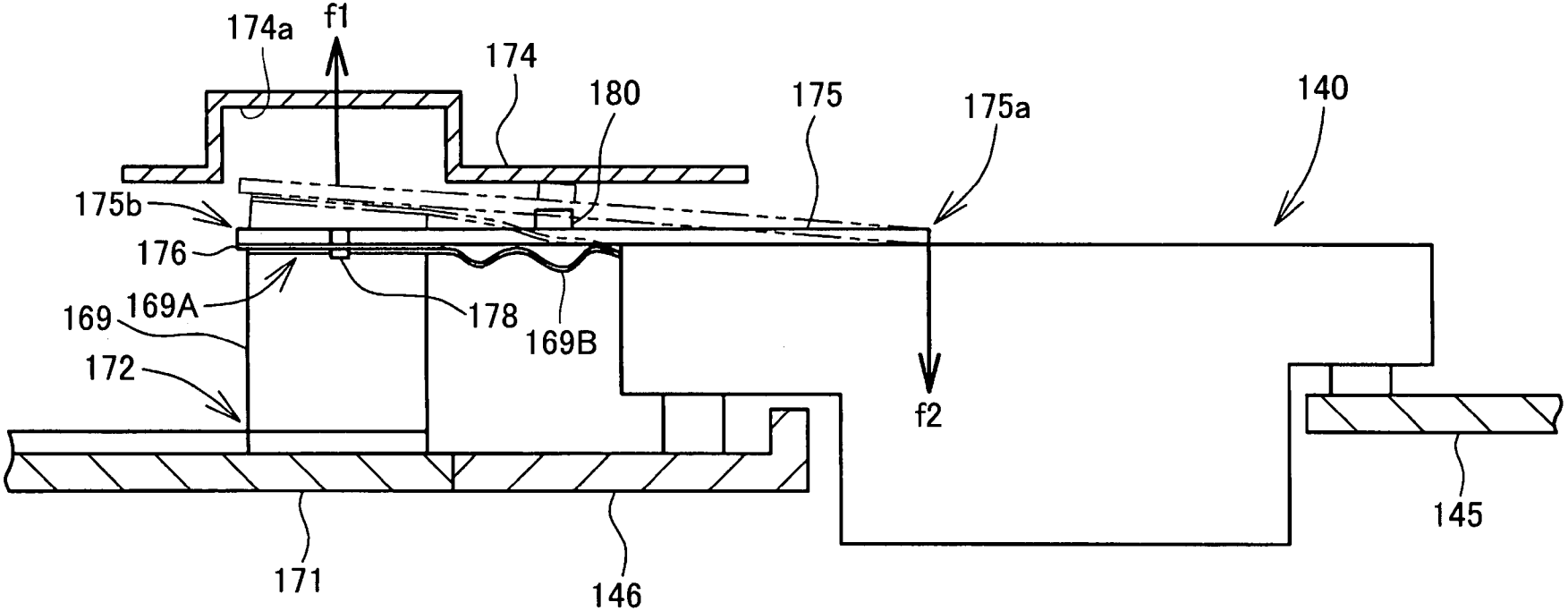
FIG. 18 is a vertical cross-sectional view illustrating the rotation of the supporting member in the second illustrative aspect.

However, when the folded portion 169A of the flat cable 169 moves upward, as shown in FIG. 18, the supporting member 175 supporting the region of the folded portion 169A from above also moves upward. At this time, the restricting member 180 protruding from the top of the supporting member 175 contacts the bottom surface of the top cover 174. Hence, force f1 acting on the supporting member 175 to pivotally move the supporting member 175 upward due to the restoring force of the flat cable 169 is transferred to a downward force f2 applied to the base end 175*a*. In this case, the restricting member 180 serves as a fulcrum. Thus, the force f2 pushes down the carriage 140. Accordingly, the force f1 does not raise the carriage 140 up from the guide rail 146.

Further, rather than canceling the force f1 generated by the restoring force of the flat cable 169 through contact with the top cover 174, the restricting member 180 acts as a fulcrum for converting the force f1 to a force f2 pushing down on the carriage 140. Hence, the restricting member 180 minimizes the force of contact with the top cover 174. Although the force f2 is applied to the carriage 140 at the base end 175*a* of the supporting member 175, little rotational moment is generated since the base end 175*a* is positioned near the driving center of gravity of the carriage 140. Hence, this construction reduces the sliding load and rotational moment acting on the carriage 140.

When the folded portion 169A of the flat cable 169 does not move upward as indicated by the solid line in FIG. 18, that is, when the carriage 140 moves in the direction opposite the extending direction of the flat cable 169 (to the left in FIG. 15) so that the radius of the curved part 170 grows larger and the distance between the carriage 140 and the intermediate engaging part 172 increases, the restoring force acting on the folded portion 169A decreases. Hence, the folded portion 169A does not pivotally move the supporting member 175 upward, and the supporting member 175 remains resting on the top surface of the carriage 140. In this state, the restricting member 180 does not contact the top cover 174.

In other words, since the restricting member 180 restricts the supporting member 175 from pivotally moving upward past a prescribed range, the restricting member 180 does not contact the top cover 174 when the supporting member 175 is within this prescribed range. Accordingly, a frictional force is not produced between the restricting member 180 and top cover 174 at this time, and the force f2 pressing against the carriage 140 is not generated. With this construction, the restricting member 180 does not contact the top cover 174 as long as the folded portion 169A does not pivotally move the supporting member 175 upward to a degree sufficient to raise the carriage 140 and, hence, an unnecessary sliding load is not applied to the carriage 140. The pivotally moving range of the supporting member 175 is a range within which the restoring force of the flat cable 169 does not raise the carriage 140. However, it is preferable that the supporting member 175 is pivotally movable within a range that allows the folded portion 169A of the flat cable 169 to flutter along with the reciprocating movement of the carriage 140.

As described above, the flat cable 169 leads out from the top portion of the carriage 140 to increase the minimum radius of the curved part 170 as the flat cable 169 changes shape along with the reciprocation of the carriage 140. This configuration reduces the restoring force produced by the bending rigidity of the flat cable 169, thereby minimizing the range in the reciprocating direction of the carriage 140 during which the supporting member 175 is pivotally moved upward and the restricting member 180 contacts the top cover 174. As a result, it is possible to reduce the sliding load applied to the carriage 140.

As described above, the section of the flat cable 169 from the carriage 140 to the folded portion 169A is given a degree of slackness to allow the supporting member 175 to be pivotally movable until the restricting member 180 contacts the top cover 174. Therefore, the section of the flat cable 169 leading out from the carriage 140 does not become taut, even when the supporting member 175 is pivotally moved upward along with movement of the folded portion 169A. In other words, movement of the folded portion 169A is absorbed by the slack part 169B of the flat cable 169 so that this movement is not transferred as a force pushing against the carriage 140.

In the multifunction device 101 according to the second illustrative aspect, the restricting member 180 contacts the top cover 174 at a prescribed position when the restoring force of the flat cable 169 raises the folded portion 169A and pivotally moves the supporting member 175 upward. By acting as a fulcrum, the restricting member 180 applies a force f2 to the carriage 140 pushing downward thereon to prevent the carriage 140 from raising from the guide rail 146. Hence, this construction ensures that the carriage 140 remains in a stable position and that a stable load is applied to the carriage 140 during the reciprocating movement thereof, thereby improving the precision of image recording.

Next, an image-recording device according to a third illustrative aspect of the invention will be described with reference to FIGS. 19 through 21. The image-recording device according to the third illustrative aspect is a multifunction device 201. Since the multifunction device 201 has primarily the same construction as that of the multifunction device 1 according to the first illustrative aspect, unless otherwise stated, a value of 200 will be added to each reference numeral in the first illustrative aspect (except for 271, 272, 273, 274 and 275) and a description of these components will be omitted.

Figure 20:
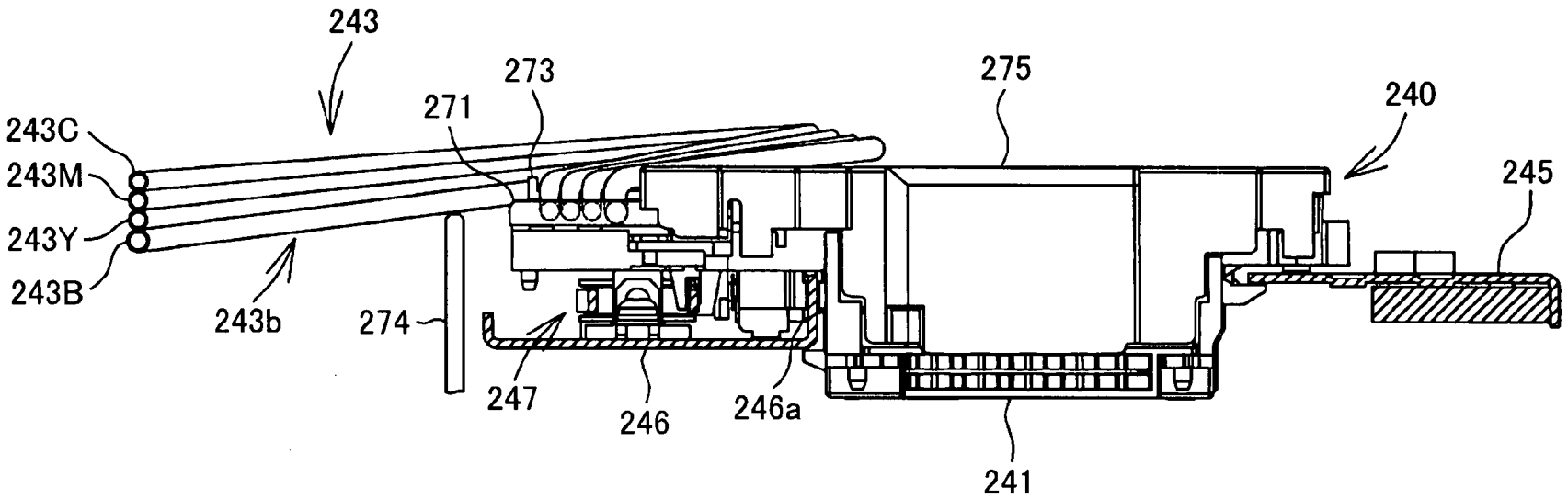
FIG. 20 is an enlarged side view of a printing section around the carriage according to the third illustrative aspect.

As shown in FIG. 20, the multifunction device 201 according to the third illustrative aspect also includes the ink supply tubes 243. Of these, the ink supply tube 243B for supplying black ink has a larger diameter than that of the ink supply tubes 243C, 243M, and 243Y. The reason for this is as follows. When recording text images including characters and the like, monochromatic image recording is formed primarily using black ink. In order to improve the recording speed and the like when using the black ink, the number of the ejection holes 253*a* corresponding to black ink must be greater than that of the ink ejection holes 253*a* of the other colors. To this effect, the ink supply tube 243B is increased in diameter to increase the supplying amount of black ink to the recording head 241 per unit time.

As shown in FIG. 20, a tube connector 271 is provided on the downstream end of the carriage 240 in the paper-conveying direction and protrudes farther downstream in the same direction. The ink supply tubes 243 are coupled to the tube connector 271 and supported by the tube connector 271 in a substantially horizontal orientation in terms of an array of the ink supply tubes. Although not shown in detail in the drawing, ink in each color supplied from the ink supply tubes 243 is guided into the corresponding buffer tank 57 (FIG. 6) of the recording head 241.

Figure 19:
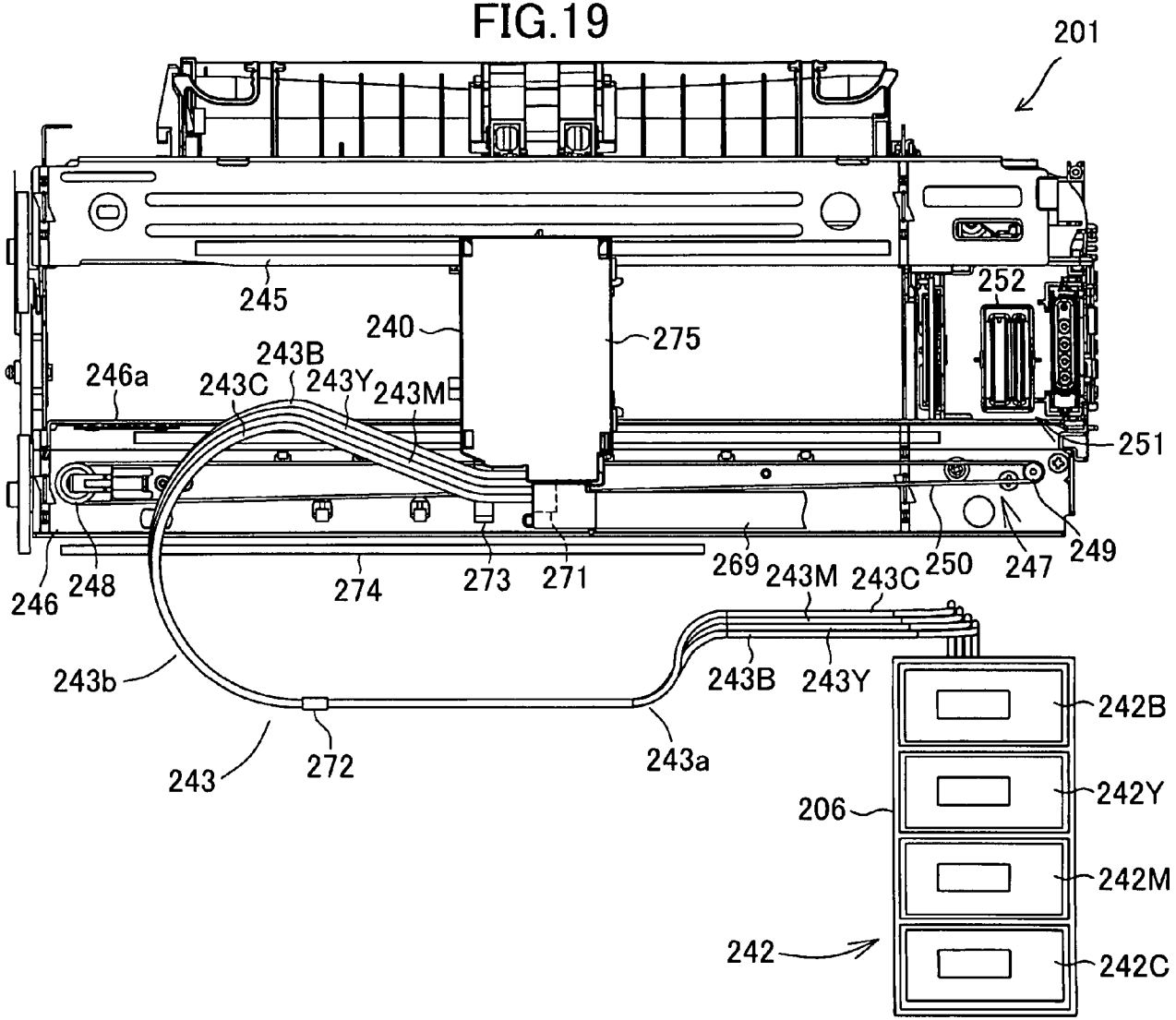
FIG. 19 is a plan view showing a layout of the carriage, ink tanks, and ink supply tubes according to a third illustrative aspect of the invention.

As shown in FIG. 19, the ink supply tubes 243 extending substantially horizontally from the tube connector 271 in the reciprocating direction of the carriage 240 gradually change from being juxtaposed along the horizontal to being juxtaposed vertically at the curved center portion 243*b*. After the center portion 243*b*, the ink supply tubes 243 extend in a direction opposite the initial direction until arriving at a center fixed part 243*a*. The vertically juxtaposed orientation of the ink supply tubes 243 is maintained from the center portion 243*b* to the fixed part 243*a*.

By arranging the ink supply tubes 243 in the horizontally juxtaposed orientation at the tube connector 271, it is possible to reduce the height of the space required around the carriage 240. As shown in FIGS. 19 and 20, many components, such as the guide rails 245 and 246, the belt drive mechanism 247, and the flat cable 269, are disposed around the carriage 240. By arranging the ink supply tubes 243 in the horizontally juxtaposed orientation and extending the ink supply tubes 243 substantially horizontally from the tube connector 271, it is possible to dispose these components in a layout that does not interfere with the ink supply tubes 243, while reducing the height of the space around the recording head 241.

On the other hand, by arranging the ink supply tubes 243 in the vertically juxtaposed orientation from the center portion 243*b* to the center fixed part 243*a*, the space in the depthwise direction of the device can be reduced. In other words, although it is desirable to reduce the vertical space around the carriage 240, reducing the space in the depthwise direction can also contribute to the production of an over-all compact device, depending on the relationship with the scanning unit 203 (FIG. 2) and the like disposed above the printing unit 202 (FIG. 2).

Figure 21:
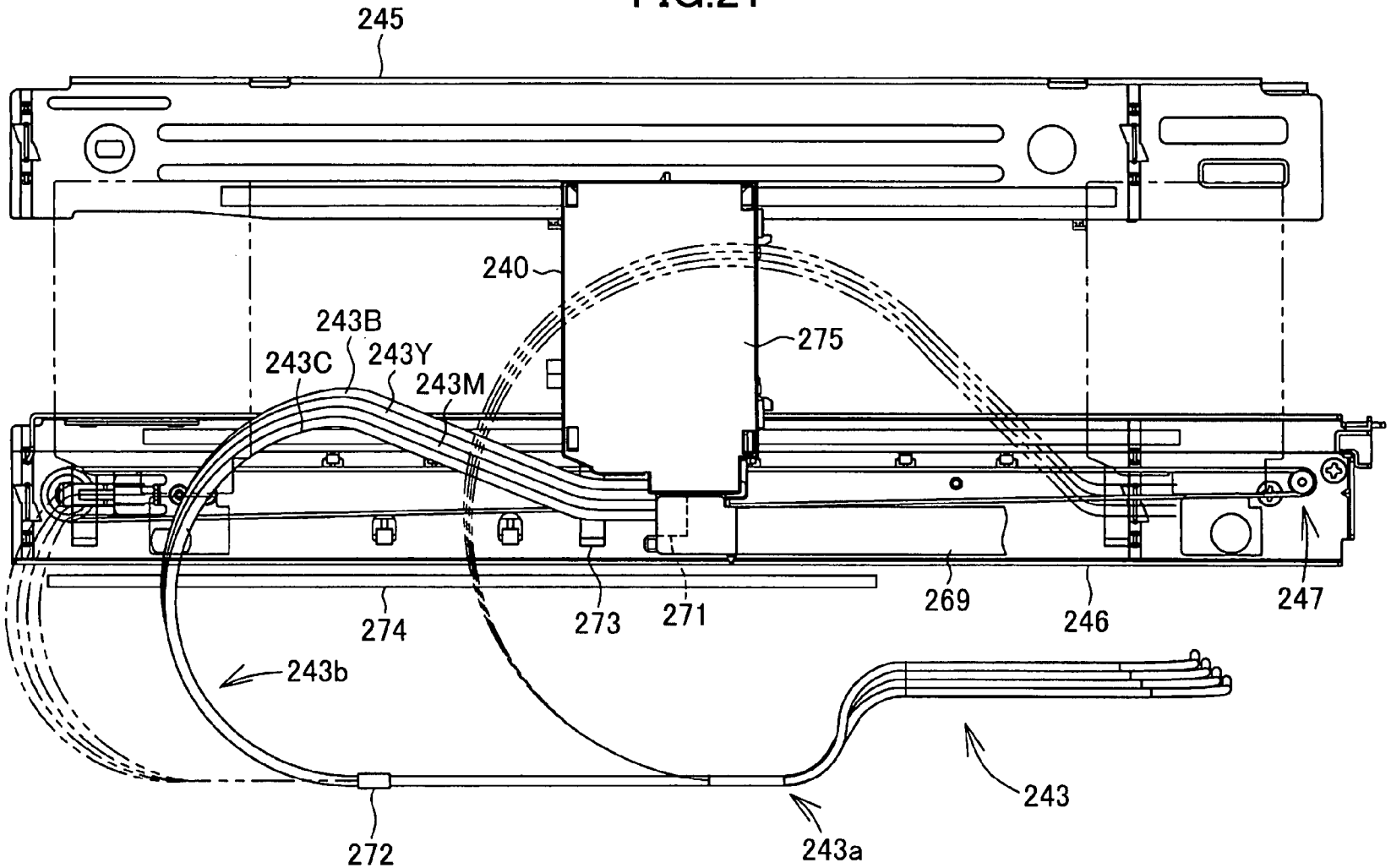
FIG. 21 is a plan view illustrating ink supply tubes that follow reciprocating motion of the carriage according to the third illustrative aspect.
Figure 22:
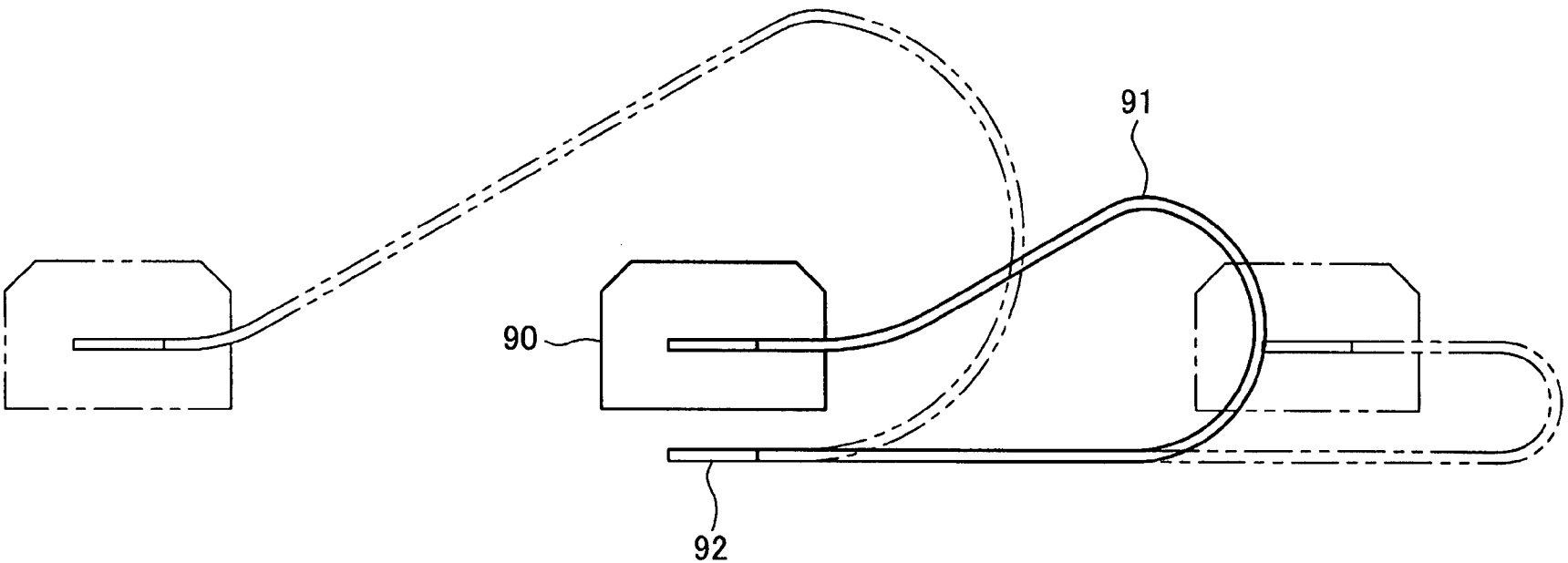
FIG.22 PRIOR ART
FIG. 22 is an explanatory diagram illustrating a carriage and a flat cable in a conventional image-recording device.
Figure 23:
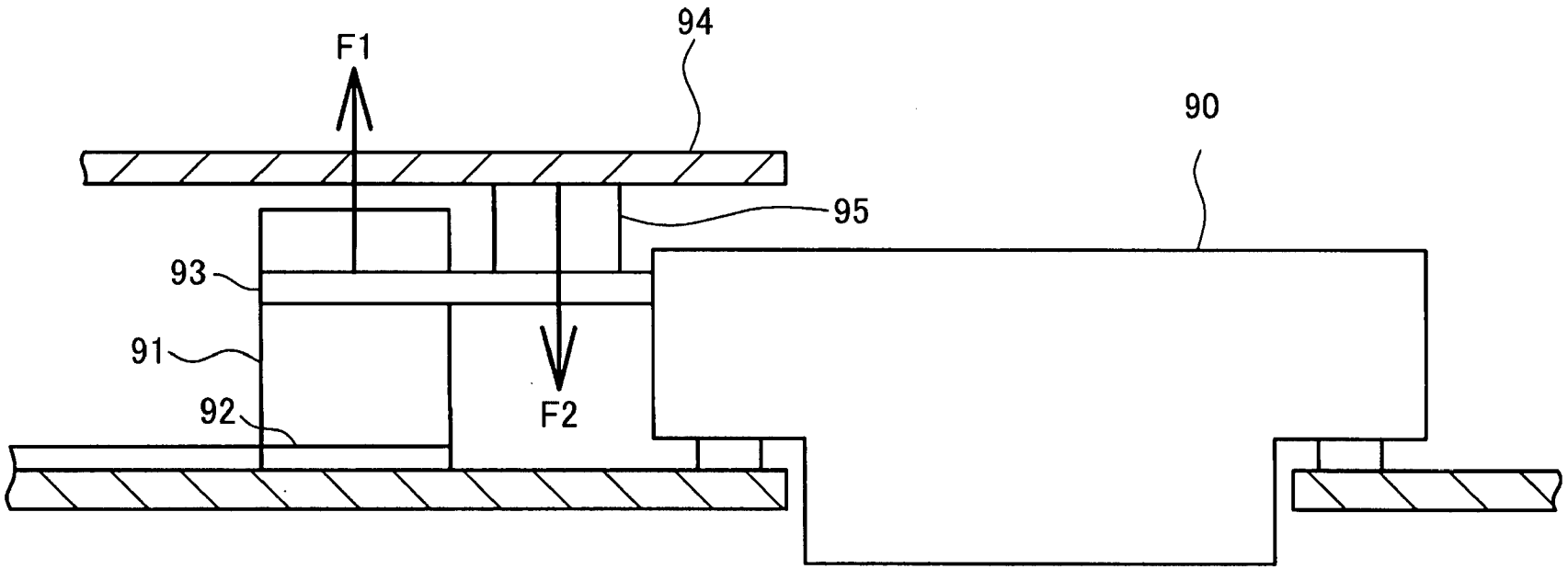
FIG.23 PRIOR ART
FIG. 23 is an explanatory diagram showing an elastic member used to prevent a carriage from floating upward in another conventional image-recording device.

As shown in FIG. 21, the ink supply tubes 243 move along with the reciprocating motion of the carriage 240, while the curve in the center portion 243*b* changes in shape. Hence, the section of the ink supply tubes 243 on the carriage 240 side of the center fixed part 243*b* follow the carriage 240 when the carriage 240 reciprocates. When the carriage 240 moves toward one end of the reciprocating direction (the left side in FIG. 21), the ink supply tubes 243 follow this movement of the carriage 240, while flexing so that the radius of the center portion 243*b* grows smaller, as shown by the two dotted chain line in FIG. 21. At this time, the section of the ink supply tubes 243 from the center fixed part 243*a* to the center portion 243*b* forms a straight line in the reciprocating direction along the frame of the device (not shown). When the recording head 241 moves to the other end in the reciprocating direction (the right side in FIG. 21), the ink supply tubes 243 follow this movement while flexing so that the radius of the center portion 243*b* grows larger, as indicated by another two dotted chain line in FIG. 21.

As described above, the ink supply tubes 243 are juxtaposed in a row that changes from the vertical orientation to a horizontal orientation from the center fixed part 243*a* to the tube connector 271. This construction makes it unlikely for the ink supply tubes 243 to move about wildly in the vertical direction at the center portion 243*b* when the ink supply tubes 243 follow the movement of the carriage 240. Further, since the ink supply tubes 243 are independent of one another, the ink supply tubes 243 can easily flex to form the curved center portion 243*b* that can easily fluctuate in radius, without any force that may interfere with the movement of the carriage 240.

Further, the independent ink supply tubes 243 are bundled together by a bundling member 272 on the center fixed part 243*a* side of the center portion 243*b*. The bundling member 272 is a band-like member formed of metal or synthetic resin that bands the ink supply tubes 243 together in a vertically juxtaposed arrangement. The bundling member 272 should be placed around the ink supply tubes 243 on the center fixed part 243*a* side of the center portion 243*b*, at which location the ink supply tubes 243 are arranged vertically and should be positioned so as not to interfere with the guide rail 246, belt drive mechanism 247, or other components. With this construction, the ink supply tubes 243 can be kept independent of each other so as to be able to flex easier at the center portion 243*b*, while the bundling member 272 prevents the juxtaposed arrangement of the ink supply tubes 243 from becoming disorderly as the ink supply tubes 243 follow the movement of the carriage 240.

As shown in FIGS. 19 and 20, the ink supply tube 243B for black ink that has a greater diameter than the ink supply tubes 243C, 243M, and 243Y is disposed in the bottommost position from the center portion 243*b* to the center fixed part 243*a* because the ink supply tube 243B has a greater bending rigidity than the other ink supply tubes 243. Accordingly, by disposing the ink supply tube 243B in the bottommost position, the ink supply tube 243B can support the other ink supply tubes 243. This configuration prevents the ink supply tubes 243C, 243M, and 243Y disposed above the ink supply tube 243B from sagging downward at the center portion 243*b*, in particular.

The ink supply tubes 243 arranged in this manner are supported both on a tube supporting part 273 disposed near the tube connector 271 of the carriage 240, but also by a supporting rib 274 near the center portion 243*b*. Each of the ink supply tubes 243 is supported on the tube supporting part 273 and supporting rib 274, thereby preventing the ink supply tubes 243 from sagging downward and contacting the guide rail 246, belt drive mechanism 247, encoder strip, or other member. In this way, the ink supply tubes 243 are not damaged, and the encoder strip is not contaminated by the ink supply tubes 243, which contamination could influence the detected position of the carriage 240.

As shown in FIG. 19, the tube supporting part 273 protrudes downstream in the paper-conveying direction from a downstream end of a head cover 275 constituting part of the carriage 240. The tube supporting part 273 is an L-shaped member oriented laterally with a plate-shaped member extending downstream in a horizontal direction and subsequently bending upward at a right angle on the downstream end. The ink supply tubes 243 are supported on the top surface of the tube supporting part 273. The tube supporting part 273 are preferably formed integrally with the head cover 275 of a synthetic resin material so that the carriage 240 can be made more compact while eliminating the step of attaching the tube supporting part 273 to the carriage 240. However, the tube supporting part 273 may also be formed as a separate member from the head cover 275 and fixed to the carriage 240 by screws or the like. Further, while the tube supporting part 273 is integrally molded with the head cover 275 of the carriage 240 in the preferred illustrative aspect, the tube supporting part 273 may be instead integrally formed with the carriage 240 at another location other than the head cover 275.

As shown in FIG. 20, the tube supporting part 273 is positioned slightly higher than the tube connector 271 to which the ink supply tubes 243 are connected. Therefore, the tube supporting part 273 supports the ink supply tubes 243 extending from the tube connector 271 while raising the ink supply tubes 243 upward. By raising the ink supply tubes 243 diagonally upward from the carriage 240 to the center portion 243*b* in this way, the tube supporting part 273 prevents the ink supply tubes 243 from sagging downward and contacting the guide rail 246, belt drive mechanism 247, or other members.

Further, raising the ink supply tubes 243 diagonally upward in this way applies a reaction force to the carriage 240 that presses the carriage 240 against the guide rails 245 and 246, thereby preventing the carriage 240 from floating up from the guide rails 245 and 246 when reciprocating. The positional relationship of the tube supporting part 273 and tube connector 271 is set with consideration for the layout of the ink supply tubes 243 with respect to other components, the sagging state of the ink supply tubes 243, floating of the carriage 240, and the like. It is also possible to arrange the tube supporting part 273 and tube connector 271 at approximately the same height, for example.

The tube supporting part 273 also supports the ink supply tubes 243 in the horizontal arrangement in which they are connected to the tube connector 271. This configuration not only reduces the space required around the tube connector 271 for disposing the ink supply tubes 243, but also prevents the arrangement of the ink supply tubes 243 from becoming disordered as the ink supply tubes 243 follow the reciprocating motion of the carriage 240. Although not shown in detail in the drawings, the part of the tube supporting part 273 supporting the ink supply tubes 243 is preferably formed with protrusions and depressions following the outer periphery of the ink supply tubes 243 for restricting the ink supply tubes 243 from moving in the horizontal direction.

The supporting rib 274 is disposed downstream of the guide rail 246 in the paper-conveying direction and protrudes upward along the reciprocating direction of the carriage 240. The supporting rib 274 may be integrally molded with the device frame or another member formed of synthetic resin, or may be molded separately and fixed to the device frame or the like. As shown in FIG. 20, the top surface of the supporting rib 274 is higher than the guide rail 246, belt drive mechanism 247, and the like. Further, as shown in FIG. 21, the extending length of the supporting rib 274 corresponds to the range in which the ink supply tubes 243 move when following the reciprocating motion of the carriage 240 and is at least sufficient to support the center portion 243*b* of the ink supply tubes 243 in the region where the radius of the center portion 243*b* becomes largest and, hence, where the center portion 243*b* is most likely to sag. Accordingly, when the ink supply tubes 243 move along with the reciprocating movement of the carriage 240, the center portion 243*b* moves while being slidingly supported on the supporting rib 274, thereby preventing the center portion 243*b* of the ink supply tubes 243 from sagging and contacting other components.

In the illustrative aspect described above, the multi-function device 201 performs image recording operation with four-color inks, and therefore requires four ink supply tubes 243. However, the image-recording device of the invention is not particularly limited to the number of ink colors, as mentioned above. For example, the image-recording device may be configured to perform image recording with six or eight colors of ink, in which cases the number of ink supply tubes 243 would be increased. If there is insufficient space around the carriage 240 for arranging the six or eight ink supply tubes 243 horizontally, the ink supply tubes 243 may be divided into two groups and extend from both the left and sides of the carriage 240, with the two groups of ink supply tubes being arranged and curved in opposite directions before being connected to the ink tanks 242. In this case, the tube supporting part 273 and supporting rib 274 can be provided on both left and right sides of the device to correspond to the two groups of ink supply tubes.

Further, the third illustrative aspect regarding the arrangement of the ink supply tubes and supporting structure therefore can be incorporated into the first and second illustrative aspects of the present invention.

While the invention has been described in detail with reference to the above aspects thereof, it would be apparent to those skilled in the art that various changes and modifications may be made therein without departing from the spirit of the invention.

What is claimed is:

1. An image-recording device for recording an image on a recording medium conveyed in a feeding direction, the device comprising:

a recording head that ejects ink droplets onto the recording medium;

a carriage supporting the recording head and reciprocally movable along a linear moving direction orthogonal to the feeding direction, the carriage having an end portion in the feeding direction;

a guide rail extending in the linear moving direction and supporting at least the end portion of the carriage for guiding the carriage in the linear moving direction;

a flat cable transmitting a recording signal to the carriage and having a first part led from the end portion of the carriage and directing in a first direction in parallel with the linear moving direction, a curved part extending from the first part for inverting orientation, and a second part extending from the curved part and directed to a second direction opposite to the first direction, a length of the first part and the second part being changeable depending on the movement of the carriage in the linear moving direction;

a base positioned below the second part of the flat cable and covering a movable region of the flat cable;

a fixing part provided on the base for securing the second part to the base;

a top cover positioned above the first part of the flat cable and covering the movable region; and, a fixing member that fixes an end portion of the first part of the flat cable to the end portion of the carriage so as to extend the end portion of the first part toward the top cover obliquely upward to provide an upwardly oriented part that extends from the carriage at a prescribed angle with respect to a horizontal plane configured to permit at least a boundary portion between the first part and the curved part to be in continuous contact with the top cover while the carriage moves within a region for recording images on the recording medium.

2. The image-recording device as claimed in claim 1, wherein the upwardly oriented part has a first end fixed to the carriage and a second end in the first direction, and the curved part has an upper end, and the boundary portion includes the second end of the upwardly oriented part and the upper end of the curved part, a distance between the second end and the upper end being changeable in accordance with the movement of the carriage.

3. The image-recording device as claimed in claim 2, wherein the second end and the upper end coincide in position with each other when the distance therebetween becomes zero depending on the position of the cartridge.

4. The image-recording device as claimed in claim 1, wherein the top cover has a bottom surface and the base has a top surface facing the bottom surface in a vertical direction, the first part has a first flat surface facing the bottom surface, and the second part has a second flat surface facing the top surface, the first flat surface and the second flat surface extending in a horizontal direction.

5. The image-recording device as claimed in claim 1, wherein the carriage has an upper portion, the flat cable being led from the upper portion.

6. The image-recording device as claimed in claim 5 wherein the fixing member comprises a clip member provided at the upper portion of the carriage, the clip member comprising a sloped part on which the upwardly oriented part of the flat cable is supported, and a clamp part to position the upwardly oriented part on the sloped part by interposing the upwardly oriented part between the sloped part and the clamp part, the sloped part providing the prescribed angle.

7. The image-recording device as claimed in claim 6, wherein the prescribed angle is in a range of from 20 to 40 degrees.

8. The image-recording device as claimed in claim 1, wherein the top cover has a protruding part provided in a region that contacts the first part and the curved part of the flat cable.

9. The image-recording device as claimed in claim 8, wherein the protruding part comprises a rib extending in the linear moving direction of the carriage.

10. The image-recording device as claimed in claim 8, wherein the top cover is formed with a groove extending in the linear moving direction and having open end facing the base, the groove having a width substantially equal to a width of the flat cable, and wherein the protruding part comprises two ribs protruding from the groove and extending in the linear moving direction of the carriage and positioned in symmetrical relation with each other with respect to a widthwise center of the groove.

11. An image-recording device for recording an image on a recording medium conveyed in a feeding direction, the device comprising:

a recording head that ejects ink droplets onto the recording medium;

a carriage supporting the recording head and reciprocally movable along a linear moving direction orthogonal to the feeding direction, the carriage having an end portion in the feeding direction;

a guide rail extending in the linear moving direction and supporting at least the end portion of the carriage for guiding the carriage in the linear moving direction;

a flat cable transmitting a recording signal to the carriage and having a first part led from the end portion of the carriage and directing in a first direction in a parallel with the linear moving direction, a curved part extending from the first part for inverting orientation, and a second part extending from the curved part and directed to a second direction opposite to the first direction, a length of the first part and the second part being changeable depending on the movement of the carriage in the linear moving direction;

a base positioned below the second part of the flat cable and covering a movable region of the flat cable;

a fixing part provided on the base for securing the second part to the base; and a top cover positioned above the first part of the flat cable and covering the moveable region, the first part of the flat cable having an upwardly oriented part that extends from the carriage at a prescribed angle with respect to a horizontal plane and is configured to permit at least a boundary portion between the first part and the curved part to be in continuous contact with the top cover while the carriage moves within a region for recording images on the recording medium; and, an ink-absorbing sheet provided at the top cover and positioned in a region to which the flat cable contacts for absorbing ink mist.

12. The image-recording device as claimed in claim 1, wherein the flat cable comprises a main cable section having a first side, and a slip film covering the first side and contacting the top cover for reducing friction with the top cover.

13. The image-recording device as claimed in claim 12, wherein the slip film is bent at substantially in a width-wise center region so as to form an outward-protruding ridge along the linear moving direction.

14. The image-recording device as claimed in claim 12, wherein the slip film has a surface subjected to an antistatic treatment.

15. The image-recording device as claimed in claim 12, wherein the slip film contains an antistatic material.

16. The image-recording device as claimed in claim 12 wherein the main cable section has a second side opposite to the first side, and the flat cable further comprising a reinforcing film covering the second side that is out of contact from the top cover for increasing the bending rigidity of the resultant flat cable.

17. The image-recording device as claimed in claim 12, wherein the fixing member fixes an end portion of the main cable section and an end portion of the slip film integrally to the end portion of the carriage.

18. The image-recording device as claimed in claim 1, further comprising:

a coupling part provided at the carriage and through which ink is supplied to the recording head;

an ink tank assembly provided separately from the carriage for accommodating ink;

a flexible ink supply tube assembly connected between the coupling part and the ink tank assembly for supplying ink from the ink tank assembly to the carriage; and a tube assembly supporting part protruding from the carriage and supporting a portion of the ink supply tube assembly near the coupling part.

19. The image-recording device as claimed in claim 18, wherein the first direction and the second direction are in parallel with a horizontal direction, and wherein the ink supply tube assembly has a first region extending substantially in the second direction from the coupling part, a curved region extending from the first region so as to lead back in the first direction, and a second region extending in the first direction from the curved region and connected to the ink tank assembly.

20. The image-recording device as claimed in claim 19, further comprising a supporting piece disposed along the first and second directions, the curved region being slidably supported on the supporting piece.

21. The image-recording device as claimed in claim 18, wherein the ink tank assembly comprises a plurality of ink tanks; and wherein the ink supply tube assembly comprises a plurality of the ink supply tubes corresponding to the plurality of ink tanks and provided independently of one another.

22. The image-recording device as claimed in claim 21, further comprising a bundling member bundling the plurality of ink supply tubes together at a boundary between the curved region and the second region.

23. The image-recording device as claimed in claim 21, wherein the plurality of ink supply tubes are juxtaposed substantially along a horizontal direction near the coupling part of the carriage, the tube assembly supporting part supporting the ink supply tubes with this substantially horizontal orientation.

24. The image-recording device as claimed in claim 23, wherein the plurality of ink supply tubes are juxtaposed substantially in a vertical orientation from the curved region to the second region.

25. The image-recording device as claimed in claim 24, wherein the plurality of ink supply tubes includes a specific ink supply tube having highest bending rigidity among the plurality of ink supply tubes, the specific ink supply tube being disposed in a bottommost position in the vertical orientation.

26. The image-recording device as claimed in claim 18, wherein the tube assembly supporting part is provided integrally with the carriage.

27. An image-recording device for recording an image on a recording medium conveyed in a feeding direction, the device comprising:

a recording head that ejects ink droplets onto the recording medium;

a carriage supporting the recording head and reciprocally movable along a linear moving direction orthogonal to the feeding direction, the carriage having an end portion in the feeding direction;

a guide rail extending in the linear moving direction and supporting at least the end portion of the carriage for guiding the carriage in the linear moving direction;

a flat cable transmitting a recording signal to the carriage and having a first part led from the end portion of the carriage and directing in a first direction in parallel with the linear moving direction, a curved part extending from the first part for inverting orientation, and a second part extending from the curved part and directed to a second direction opposite to the first direction, a length of the first part and the second part being changeable depending on the movement of the carriage in the linear moving direction;

a base positioned below the second part of the flat cable and covering a movable region of the flat cable;

a fixing part provided on the base for securing the second part to the base;

a top cover positioned above the first part of the flat cable and covering the movable region, the first part of the flat cable having an upwardly oriented part that extends from the carriage at a prescribed angle with respect to a horizontal plane and is configured to permit at least a boundary portion between the first part and the curved part to be in continuous contact with the top cover while the carriage moves within a region for recording images on the recording medium;

a coupling part provided at the carriage and through which ink is supplied to the recording head;

an ink tank assembly provided separately from the carriage for accommodating ink;

a flexible ink supply tube connected between the coupling part and the ink tank assembly for supplying ink from the ink tank assembly to the carriage; and a tube assembly supporting part protruding from the carriage and supporting a portion of the ink supply tube assembly near the coupling part; and a supporting piece disposed along the first and second directions, the curved region being slidably supported on the supporting piece;

wherein the first direction and the second direction are in parallel with a horizontal direction, and wherein the ink supply tube assembly has a first region extending substantially in the second direction from the coupling part, a curved region extending from the first region so as to lead back in the first direction, and a second region extending in the first direction from the curved region and connected to the ink tank assembly.

* * * * *